US008348682B1

(12) United States Patent
Draggie et al.

(10) Patent No.: US 8,348,682 B1
(45) Date of Patent: Jan. 8, 2013

(54) METHOD FOR ELECTRICAL OUTLET HAVING GROUNDS-OUT RECEPTACLES

(75) Inventors: Raymond Q. Draggie, Renton, WA (US); Scott D. Maxwell, Renton, WA (US); Marian D. Maxwell, Renton, WA (US); Charles A. Lemaire, Apple Valley, MN (US)

(73) Assignee: Mechanical Answers LLC, Renton, WA (US)

( * ) Notice: Subject to any disclaimer, the term of this patent is extended or adjusted under 35 U.S.C. 154(b) by 0 days.

(21) Appl. No.: 13/244,477

(22) Filed: Sep. 25, 2011

Related U.S. Application Data

(62) Division of application No. 12/873,241, filed on Aug. 31, 2010, now Pat. No. 8,025,527, which is a division of application No. 11/868,964, filed on Oct. 9, 2007, now Pat. No. 7,785,139, which is a division of application No. 11/094,631, filed on Mar. 29, 2005, now Pat. No. 7,278,878.

(60) Provisional application No. 60/557,006, filed on Mar. 29, 2004.

(51) Int. Cl.
*H01R 4/66* (2006.01)

(52) U.S. Cl. ..... 439/107

(58) Field of Classification Search ..... 439/107, 439/535–538, 214–215
See application file for complete search history.

(56) References Cited

U.S. PATENT DOCUMENTS 824,700 A 7/1906 Avery
1,171,914 A 2/1916 Wright
D61,027 S 6/1922 Benjamin
D87,428 S 7/1932 Cahn
2,097,346 A 10/1937 Russel et al.
D126,590 S 4/1941 Lewin
D130,827 S 12/1941 O'Brien
3,310,770 A 3/1967 Ramsing
3,327,277 A 6/1967 Ramsing
3,358,261 A 12/1967 Gaines et al.
3,441,896 A 4/1969 Hawkins
3,478,295 A 11/1969 Grieshaber
(Continued)

OTHER PUBLICATIONS

Acoustic Research (Company), "Acoustic Research 8-Outlet Surge Suppressor with Coax Protection", "http://www.110220volts.com/Merchant2/merchant.mvc?Screen=PROD&Product_Code=AP-08VCategory_Code=H_Surge_Protectors", 2006.

(Continued)

*Primary Examiner* — Jean F Duverne
(74) *Attorney, Agent, or Firm* — Charles A. Lemaire; Jonathan M. Rixen; Lemaire Patent Law Firm, P.L.L.C.

(57) ABSTRACT

A method, apparatus and means to address the problem of utilizing two large power plugs with transformers, converters and/or 90 degree plugs simultaneously with one duplex power receptacle. The duplex power receptacle has a ground-up and ground-down configuration, such that two conventional large three prong power plugs with transformers, converters and/or 90 degree plugs can be used simultaneously. This configuration can be utilized while still maintaining many characteristics of conventional duplex power receptacles such as left and right orientation of neutral and hot conducting busses. By maintaining characteristics of the conventional duplex power receptacle one knowledgeable in the art can install this invention without having to be retrained in a method of installation and a conventional wall outlet box and cover plate will accommodate this invention. Additionally, by maintaining these characteristics users of this invention will not have to learn any new method of using the device.

20 Claims, 20 Drawing Sheets

U.S. PATENT DOCUMENTS

| | | | | |
|---|---|---|---|---|
| 3,626,354 | A | | 12/1971 | Banner |
| 3,908,109 | A | | 9/1975 | Studebaker |
| 4,240,686 | A | | 12/1980 | Kurbikoff |
| D274,808 | S | | 7/1984 | Schwartz |
| 4,583,799 | A | | 4/1986 | Wiley |
| D287,358 | S | | 12/1986 | Schwartz |
| 4,740,167 | A | | 4/1988 | Millhimes et al. |
| 4,974,844 | A | | 12/1990 | Richards |
| 4,978,318 | A | * | 12/1990 | Wiley et al. ..... 439/536 |
| 5,078,614 | A | | 1/1992 | Shotey |
| 5,087,207 | A | | 2/1992 | Byrne |
| 5,109,316 | A | | 4/1992 | Murphy |
| 5,135,411 | A | | 8/1992 | Wiley et al. |
| D356,294 | S | | 3/1995 | Fladung |
| D360,873 | S | | 8/1995 | Starec et al. |
| 5,484,299 | A | | 1/1996 | Schlessinger |
| 5,594,208 | A | | 1/1997 | Cancellieri et al. |
| 5,601,455 | A | | 2/1997 | Bagga |
| D379,796 | S | | 6/1997 | Bagga |
| D382,855 | S | | 8/1997 | Salmond et al. |
| D402,186 | S | | 12/1998 | Pearse |
| D404,770 | S | | 1/1999 | Meade et al. |
| D405,763 | S | | 2/1999 | Crane et al. |
| 5,899,761 | A | | 5/1999 | Crane et al. |
| D411,168 | S | | 6/1999 | Rossman et al. |
| 5,967,815 | A | | 10/1999 | Schlessinger et al. |
| 5,998,735 | A | | 12/1999 | Patterson, Jr. |
| D421,966 | S | | 3/2000 | Allen et al. |
| 6,107,585 | A | | 8/2000 | Gehr |
| 6,113,434 | A | | 9/2000 | Pate |
| D434,002 | S | | 11/2000 | Rossman et al. |
| D434,393 | S | | 11/2000 | Gehr |
| 6,200,159 | B1 | | 3/2001 | Chou |
| D447,332 | S | | 9/2001 | Pisarevsky |
| 6,302,743 | B1 | | 10/2001 | Chiu et al. |
| D450,037 | S | | 11/2001 | Yu |
| D450,038 | S | | 11/2001 | Yu |
| 6,443,746 | B1 | | 9/2002 | Yu |
| D464,329 | S | | 10/2002 | Mainiero |
| 6,638,074 | B1 | | 10/2003 | Fisher |
| 6,710,274 | B2 | | 3/2004 | Whetzel et al. |
| D498,213 | S | | 11/2004 | Savicki, Jr. et al. |
| 6,817,873 | B1 | | 11/2004 | Gorman |
| D500,808 | S | | 1/2005 | Howard |
| 6,840,648 | B2 | | 1/2005 | Bryant et al. |
| 6,854,226 | B2 | | 2/2005 | Cole et al. |
| 6,894,221 | B2 | | 5/2005 | Gorman |
| 6,923,663 | B2 | | 8/2005 | Oddsen et al. |
| 6,932,624 | B1 | | 8/2005 | Hoopes et al. |
| 6,955,559 | B2 | | 10/2005 | Pyrros |
| 6,957,012 | B2 | | 10/2005 | He et al. |
| 6,962,506 | B1 | | 11/2005 | Krobusek |
| 6,979,212 | B1 | | 12/2005 | Gorman |
| 6,986,674 | B1 | | 1/2006 | Gorman |
| 7,001,211 | B2 | | 2/2006 | Lichtscheidl et al. |
| 7,098,403 | B2 | | 8/2006 | Jolley |
| 7,217,897 | B2 | | 5/2007 | Mattarelli |
| 7,255,596 | B2 | | 8/2007 | Pyrros |
| 7,282,642 | B2 | | 10/2007 | Schmieta et al. |
| 7,311,558 | B2 | | 12/2007 | Adams et al. |
| 7,347,724 | B2 | | 3/2008 | Crupi |
| 7,488,203 | B2 | | 2/2009 | Leddusire |
| 7,824,196 | B1 | * | 11/2010 | Oddsen et al. ..... 439/106 |
| 2003/0226681 | A1 | | 12/2003 | Lindenstraus et al. |
| 2006/0057873 | A1 | | 3/2006 | Ortega |

OTHER PUBLICATIONS

Deltec Electronics Corp. , "Power Sentry 100384 8-Outlet TV/DVD and Computer Surge Protector", "http://www.110220volts.com/Sub/prods/100384.html", download Jun. 21, 2006.

* cited by examiner

METHOD FOR ELECTRICAL OUTLET HAVING GROUNDS-OUT RECEPTACLES

RELATED APPLICATIONS

This application is a divisional of Ser. No. 12/873,241 filed Oct. 31, 2010 entitled "ELECTRICAL OUTLET HAVING GROUNDS-OUT RECEPTACLES AND METHOD" (which issued as U.S. Pat. No. 8,025,527 on Sep. 27, 2011), which is a divisional of U.S. patent application Ser. No. 11/868,964 filed Oct. 9, 2007 entitled "ELECTRICAL OUTLET HAVING GROUNDS-OUT RECEPTACLES AND METHOD" (which issued as U.S. Pat. No. 7,785,139 on Aug. 31, 2010), which was a divisional of U.S. patent application Ser. No. 11/094,631 filed Mar. 29, 2005 entitled "METHOD AND APPARATUS FOR A.C. OUTLET HAVING GROUNDS-OUT RECEPTACLES" (which issued as U.S. Pat. No. 7,278,878 on Oct. 9, 2007), which claimed benefit to U.S. Provisional Patent Application No. 60/557,006 entitled "GROUND UP-GROUND DOWN A.C. RECEPTACLE," filed Mar. 29, 2004 by Raymond Q. Draggie and Scott D. Maxwell, each of which is incorporated herein by reference in its entirety.

FIELD OF THE INVENTION

This invention relates to the field of electric power outlets, and more particularly to a method and apparatus for an electrical power outlet having a pair of three-prong power receptacles configured with their ground sockets oriented outward, while retaining a standard wiring configuration.

BACKGROUND OF THE INVENTION

Residential electrical circuitry originally used a "two-pole, two-wire, two-prong" configuration with each receptacle having a hot slot (also called the phase, line, or hot slot), and a neutral/ground slot. These receptacles did not have a separate equipment-grounding mechanism or connection. One pole is called the hot, phase, line, or hot wire, and the other pole is called the neutral. In the two-pole configuration, the neutral also served as a ground. A receptacle is a device with female contacts that is part of an outlet typically installed in a wall or on equipment, and which is intended to establish electrical connection with, and provide power to, an inserted plug. A wall-mounted duplex outlet will have two receptacles. A plug is a device with male blades which, when inserted into a receptacle, establishes connection between the conductors of the attached flexible cord and the conductors connected to the receptacle. With the original "two-pole, two-wire" scheme, the only grounding point was at the service entrance, where the neutral (white) conductor was grounded. At some point, the NEMA (National Electrical Manufacturers Association) configuration 1-15R required that the receptacle slot for the neutral wire (typically having white-colored insulation) be longer than the slot for the hot wire (typically having black- or red-colored insulation), and that the blade of the neutral wire on the plug be wider than the hot blade, in order that it could not be inserted into the shorter hot slot. This enables certain types of equipment, like power-supply transformers and home appliances, to have their external metal parts or casing grounded through the white neutral wire connection. Such equipment uses a polarized plug where the neutral plug blade is wider than the hot plug blade, ensuring that it can only be inserted into a NEMA 1-15R configuration receptacle with the correct orientation.

Many modern power outlets and power plugs now have what is termed a two-pole, three-wire, three-prong design, which in the U.S., is typically used for conventional 120 V.A.C. (volts alternating current) convenience power outlets. Such power outlets typically include two receptacles and are known as duplex outlets. These configurations provide a separate ground wire from the receptacle that is typically connected to neutral and ground/earth at the residential circuit-breaker box. A modern three-prong power plug has three male blades or prongs that are typically nickel plated, tin, or brass, and that are inserted into three respective female slots or sockets of a wall receptacle. The prongs of the power plug and the female slots or sockets of the wall-mounted power receptacle vary in terms of size and shape based upon the purpose that they serve. One of the prongs, (the "ground prong") is typically longer than the other two prongs, and in some embodiments is circular, semi-circular, or rounded in shape. Another of the prongs, the ("neutral prong") has a blade that is slightly wider than the third prong's blade (the "hot prong"). Many power plugs are still made with only the hot and -neutral prongs ("two prong power plugs"), and omit the ground prong. Such two-prong plugs are often polarized, with the neutral blade wider than the hot blade. A three-socket power receptacle will accept either two-prong or three-prong power plugs.

Corresponding to the three male prongs of the plug are three female slots or sockets (i.e., the hot socket, neutral socket, and ground socket) of the power receptacle into which the plug's prongs are inserted. The power receptacle's sockets are designed to accommodate the size and length variations and allow either two-prong or three-prong power plugs to be inserted, while preventing or making it difficult to insert a two-prong plug the wrong way (e.g., with the neutral prong of the plug inserted into the hot socket of the power receptacle). The neutral socket of the power receptacle and the neutral prong of the plug are wider than the hot socket that accepts the hot prong, such that the neutral plug is too wide to be inserted into the hot socket. As an additional safety feature, the ground prong of the plug is typically made longer than either the hot prong or the neutral prong, in order that it makes contact with the power receptacle first. Correspondingly, the ground socket that accepts the ground prong is deeper than the other two sockets so as to accommodate the increased length of the ground prong.

One reason for the three-prong design, and in particular the use of a ground prong, is to provide an electrical ground that can be connected to the outside of a device, or its metal frame or chassis, such that a person who is standing on or otherwise connected to ground will not get a shock from the device if the hot power voltage or a portion thereof is connected to the device frame by accident damage, aged components, insulation degradation, impact, or wiring mistake. If the person and the outside of the device are both at a ground voltage, there will be no current flow when the person is touching the outside of the device.

Another reason for the three-prong design relates to the need to dissipate and/or direct ambient and non-ambient electrical charges. A system of interconnected electrical circuits, such as those found in the typical residential house, acts like a capacitive antenna that can either build up and/or conduct ambient and non-ambient electrical power found in the atmosphere. For example, when a house is struck by lightning, absent the use of various ground prongs, the electrical energy of the lightening could be routed through all the ungrounded electrical circuits including appliances connected to these circuits. This electrical energy would destroy many of these ungrounded appliances. One solution to this problem is to provide a ground path to allow this electricity to be dissipated into the earth or ground.

Yet another reason behind the three-prong design, when mounted with the ground socket uppermost, may be to lessen the likelihood that a circuit could be formed directly across the hot and neutral prongs. Namely, the ground prong can act as a barrier or guard that prevents a piece of conductive material (for example, a cookie sheet) from slipping into the space between the power plug and power receptacle and forming a short circuit between the hot and neutral prongs. Were such a short circuit to occur, the high current can vaporize the metal prongs, which could cause a fire or other damage.

Power receptacles are typically set in a dual or duplex outlet configuration whereby two power receptacles are stacked one on top of one another. In most of these duplex-outlet power-receptacle configurations, the power receptacles sockets are arranged such that the hot, neutral, and ground sockets have the same orientation, and wherein each feature of the upper receptacle is approximately 39 millimeters above the corresponding feature of the lower receptacle. Further, typically, the screw connectors for the neutral and ground wires are all on one side of the outlet device, and the screw connectors for the hot wire(s) are on the opposite side of the device. Further still, many companies and electrical inspectors recommend that conventional duplex outlets be installed having the hot and neutral slots, which are set parallel to each other, oriented vertically, with the hot slot on the left and the neutral slot on the right, and the ground socket of each receptacle set above these parallel slots, in what is called a ground-up orientation or configuration. Some electricians and homeowners prefer to have the ground socket below the hot and neutral sockets (with the hot slots on the right and the neutral slots on the left), in what is called a ground-down orientation or configuration.

What is needed is an improved outlet design that retains many of the characteristics of conventional outlet designs, while providing improved usability and/or safety characteristics.

SUMMARY OF THE INVENTION

The present invention provides a method and apparatus to address the problem of attempting to simultaneously utilize two large power plugs with transformers and/or converters simultaneously with a single duplex power outlet. One advantage of the present invention is that it allows for the utilization of the conventional three-prong power plug. Additionally, some embodiments of the present invention retain identically the external characteristics of the standard duplex power outlet such as, size, shape, and the standard wiring configuration having the external portion of the neutral conducting buss (and both of its silver-colored screws) located on one side of the duplex power outlet, and the external portion of the hot conducting buss (and both of its brass-colored screws) located on the opposite side of the duplex power outlet. This allows electricians and others who are skilled in the art to install this invention without having to be retrained in a method of installation.

In some embodiments, the present invention provides a method for making a duplex electrical outlet, including configuring the outlet to have a first power receptacle and a second power receptacle both having their receptacle faces oriented to the front of the outlet, each power receptacle having a hot socket, a neutral socket, and a ground socket configured to receive a two-pronged or three-pronged plug having a hot prong, a neutral prong, and, optionally, a ground prong. Additionally, this method includes orienting the first power receptacle such that its ground socket is further from the second power receptacle than its hot socket and neutral socket, and orienting the second power receptacle such that its ground socket is further from the first power receptacle than its hot socket and neutral socket. It also includes electrically connecting the hot socket of the first power receptacle to the hot socket of the second power receptacle with a first conducting buss configured to connect to external wiring only along a first side of the outlet, electrically connecting the neutral socket of the first power receptacle to the neutral socket of the second power receptacle with a second metal buss or conducting buss configured to connect to external wiring only along a second side of the outlet opposite to the first side of the outlet, and electrically connecting the ground socket of the first power receptacle to the ground socket of the second power receptacle with a third metal buss or ground buss. In some embodiments, the ground buss is configured to connect to external wiring also along the second side of the outlet.

In some embodiments, this method further includes providing a threaded screw receiver substantially centered on a recessed surface between first power receptacle and the second power receptacle, and spacing the first power receptacle from the second power receptacle such that they accommodate a standard cover plate having two power receptacle openings and one screw opening. In some embodiments, this method additionally includes providing substantially identical back portions and conductor configurations for each of at least two different front receptacle face configurations, the two different front receptacle face configurations including a first front-receptacle face configuration having a substantially planar rectangular raised front receptacle face having both power receptacles therein, and a second front-receptacle face configuration having two separated raised front-receptacle face portions each shaped as a truncated circle. In some embodiments, this method additionally includes providing substantially identical back portions and conductor configurations for each of at least two different front receptacle face configurations, the two different front receptacle face configurations (in some embodiments, each having two separated raised front-receptacle face portions each shaped as a double-truncated circle, while other embodiments use a Decora™-type front-receptacle face), but with a third front-face-plate configuration having parallel hot and neutral slots (typically used for circuits up to 15 amps), and a fourth front-receptacle face configuration having perpendicular hot and neutral slots (typically used for circuits up to 20 amps). In still further embodiments, this method further includes connecting a hot conductive buss to at least a first and a second line screw each providing a clamp mechanism that clamps electrical wiring to the hot conductive buss that connects the first hot screw to the hot socket of the first power receptacle and connects the second hot screw to the hot socket of the second power receptacle, and having a removable link portion (break-away tab) between the first screw and the second screw.

In some embodiments, a duplex power outlet is configured to mount in a standard wall box where each of two power receptacles have a hot socket, a neutral socket and a ground socket wherein at least one of the ground sockets is in a ground-up position relative to the ground socket of a second power receptacle. In some embodiments, a duplex power outlet is provided, wherein the two power receptacles are configured such that there is an upper and lower power receptacle each having a receptacle face oriented to the front of the outlet, each power receptacle having a hot socket, a neutral socket, and a ground socket configured to receive a three-prong power plug having a hot prong, a neutral prong, and a ground prong.

In still other embodiments, a duplex power outlet is disclosed wherein the first (e.g., upper in the figures) power receptacle is configured such that ground socket is further from the second (e.g., lower in the figures) power receptacle than its hot socket and neutral sockets, the lower power receptacle is oriented such that its ground socket is further from the first power receptacle than its hot socket. and neutral sockets, the hot socket of the first power receptacle and the hot socket of the lower power receptacle are connected via a first conducting buss to a circuit, the neutral socket of the first power receptacle and neutral socket of the lower power receptacle are connected via a second conducting buss to a circuit, and the ground socket of the first and lower power receptacles are connected to a ground circuit. In some embodiments, the wire(s) attached to the conducting buss of the hot socket is/are attached via one or more threaded terminal screws. In some embodiments, a circuit is attached to the conducting buss of the neutral socket wherein the wire(s) is/are attached via one or more threaded terminal screws. In some embodiments, the ground socket of the first and lower power receptacles are connected to a ground circuit via a ground buss and ultimately a threaded grounding screw. In some embodiments, the apparatus further includes a threaded screw receiver substantially centered on a recessed surface plate between first power receptacle and the second power receptacle, and a standard duplex power outlet face. In still other embodiments, the standard duplex power outlet receptacle face is disclosed, wherein the receptacle face has a planar rectangular raised front receptacle face, and a second receptacle face configuration is disclosed having two separated raised front-receptacle face portions each shaped as a truncated circle.

In some embodiments, the standard duplex power outlet receptacle face is disclosed, wherein the first power receptacle is an upper power receptacle, and the second power receptacle is a lower power receptacle. In some embodiments, the upper power receptacle may be configured at a slant or angle relative to the lower power receptacle, which has its hot and neutral slots in a conventional vertical orientation above its ground socket; similarly, the lower power receptacle may be configured at an angle or slant relative to the upper receptacle having its hot and neutral slots in a conventional vertical orientation under its ground socket. In some embodiments, both receptacles are configured hot and neutral slots at a slant to the vertical.

In some embodiments, the apparatus includes a first hot conducting buss and a second neutral conducting buss, with the first hot conducting buss oriented above the second neutral conducting buss. In some embodiments, the first hot conducting buss includes two (2) sets of three (3) gripping fingers. Moreover, in some embodiments, the second neutral conducting buss includes two (2) sets of three (3) gripping fingers. In still other embodiments, the apparatus further includes the second neutral conducting buss oriented above the first hot conducting buss. The apparatus, in some embodiments, has a first hot conducting buss and the second neutral conducting buss both having an upper and lower portion. The upper and lower portions can be configured such that these upper portions are at an angle. In some embodiments, the apparatus further includes a body with isolating compartments into which are placed the hot and neutral conducting busses and associated sets of gripping fingers. The apparatus additionally includes a ground buss which also constitutes a yoke and attached to the ground buss is a grounding screw and clamp nut.

Some embodiments include a structure containing a means for simultaneously utilizing a first power plug in a ground-up configuration and a second power plug in a ground-down configuration, a means for receiving the first and second power plugs, a means for attaching one or more circuits to the apparatus, a means for receiving electrical power through the circuits, a means for supplying this electrical power to the first and second power plugs, a means for attaching a ground to the apparatus, and a means for attaching the apparatus to a standard wall box is disclosed.

DETAILED DESCRIPTION OF THE INVENTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. Further, the leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

For the purpose of this description, the phrase "power receptacle" is synonymous with the phrases electrical-power receptacle, main power receptacle, plug-in, outlet, power receptacle, female power prong, or any other phrase denoting an apparatus designed to provide access to electrical power using a plurality of (e.g., three) slots or sockets.

One problem with conventional duplex power receptacles lies in the both-ground-down or both-ground-up configuration of the ground sockets in the two receptacles. This configuration creates problems when using more than one larger power plug ("large power plug") such as those with a transformer/converter built into them, as used with hair dryers, battery chargers, etc., or with power plugs with cords connected at 90 degrees to the power plug (typically, the cord is directed in the direction of the ground socket of the plug). A conventional duplex power receptacle will not accommodate two such large power plugs or transformer power plugs, or two power plugs with their cords connected at 90 degrees to the power plug.

While, for many years, many manufacturers have built this same type of conventional duplex power receptacle as it accommodates most A.C. power plug applications, there has not been a duplex power receptacle for wall mounting that is manufactured to address the large-power-plug problem described above.

The phrase "power plug" is meant to be synonymous with the phrase "mains plug" and includes such standardized power plugs as the: NEMA 5-15P, NEMA 5-20P, NEMA 5-50P, NEMA 6-15P, NEMA 6-50P, NEMA 14-50P, BS 546, BS 1363, CEE 7/4, S132, AS 3112, GB 2099.1-1996, IRAM 2073, SEV 1011, Afsnit 107-2-D1, or any other power plug that has a three-prong design.

Figure 1A:
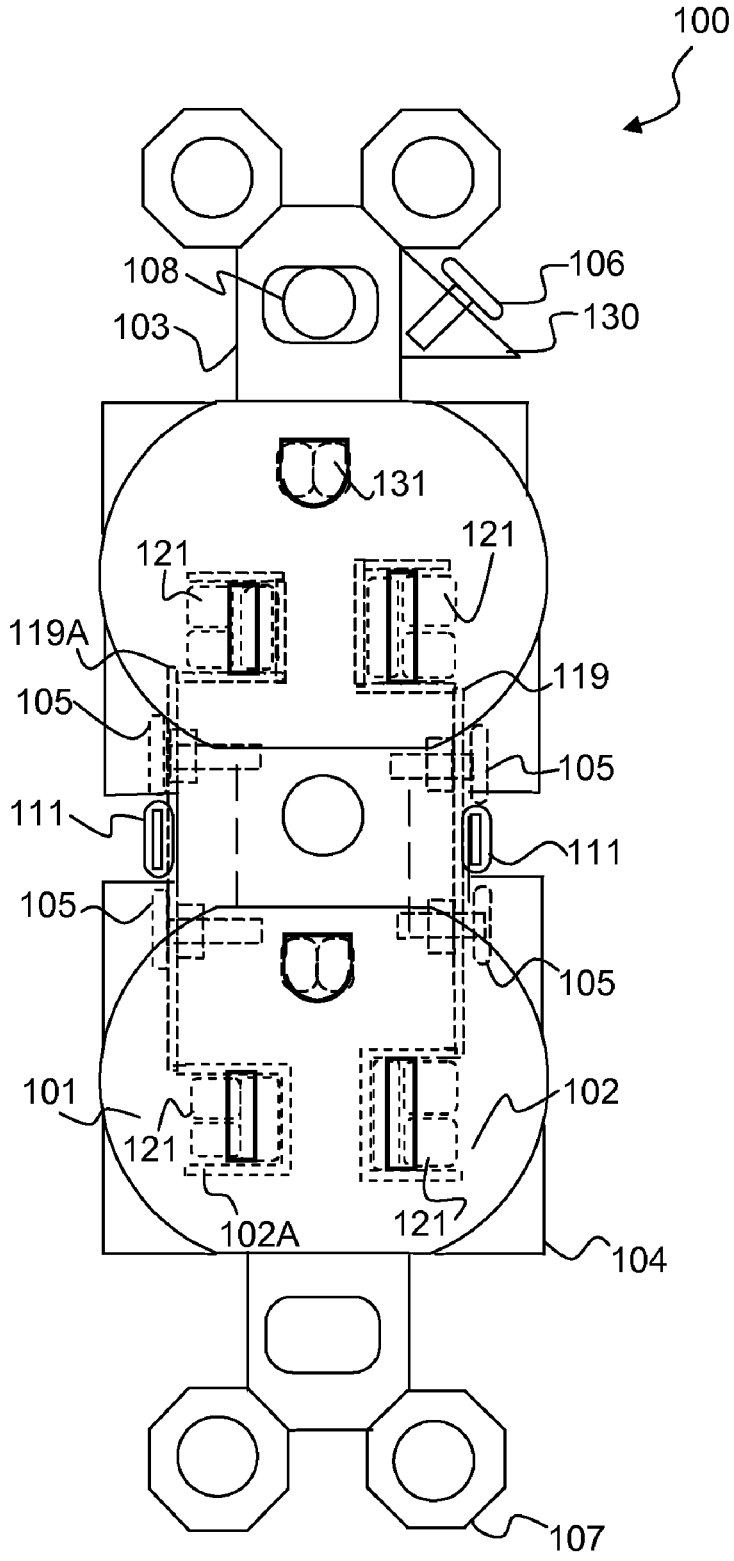
PRIOR ART FIG. 1A
FIG. 1A is a plan view of a prior-art apparatus 100 having three-prong power receptacles, with conducting busses 102 and 102A, break-away tabs 111, and terminal screws 105.

FIG. 1A discloses a conventional duplex power receptacle 100. This duplex power receptacle is composed of a variety of component parts such as a receptacle face 101, conductive busses 102/102A, and a grounding buss 103, a body 104, terminal screws 105 and 105A, ground tab 130, grounding screw 106, yoke 107, clamp nut 108, break away tabs 111, power prongs 121 and ground prongs 131.

Figure 1B:
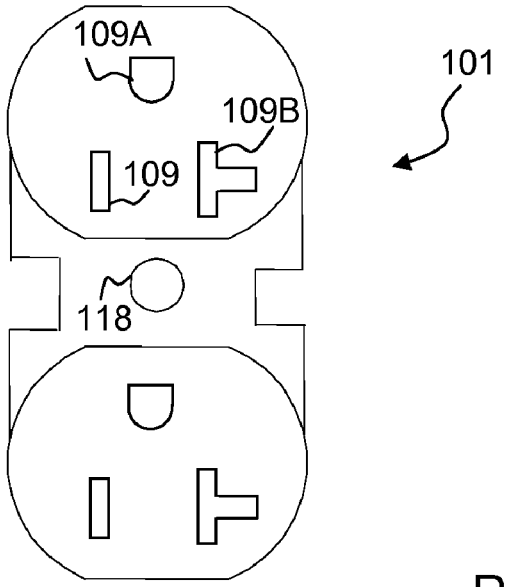
PRIOR ART FIG. 1B
FIG. 1B is a plan view of a receptacle face 101 that is part of the prior-art apparatus 100, with neutral slot openings 109B, hot slot opening 109, and ground socket opening 109A.

The receptacle face 101, depicted in FIG. 1B, discloses three openings to the sockets (i.e., reference numbers 109, 109B, 109A) into which plug the three different prongs (i.e., hot, neutral, and ground). These receptacle faces 101 are typically constructed of nylon.

Figure 1C:
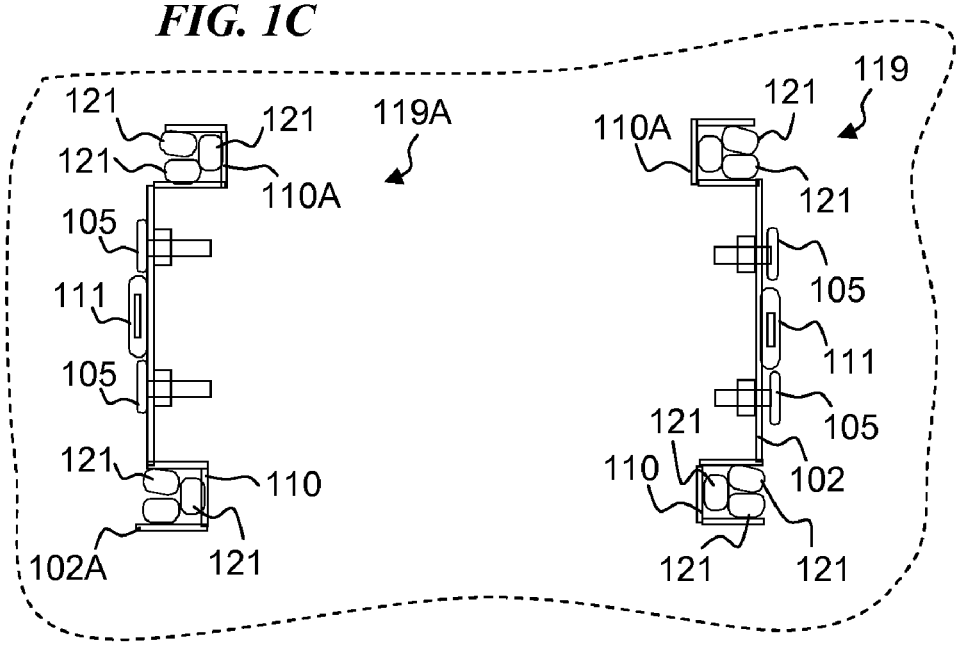
PRIOR ART FIG. 1C
FIG. 1C is a plan view of a conducting buss 102 and 102A that are part of the prior-art apparatus 100, upper 110A and lower 110 portions of the conducting busses, from which prongs 121 are configured and power supply busses 119A and 119.

The conductive busses 102/102A are illustrated in FIG. 1C. When a power plug is inserted into a power receptacle and its three associated sockets, the plug prongs make contact with the conductive busses 102/102A via gripping fingers 121 and the grounding buss 103 via gripping fingers 131 FIG. 1A. Conducting buss 102 provides an electrical current to the hot prong, while conductive buss 102A provides a neutral prong constituting an electrical return path for electricity flowing from conductive buss 102. The conducting busses 102/102A are, in turn, connected through external electrical wiring to a circuit supplying electricity. Additionally, the socket openings (i.e., reference numbers 109, 109A, 109B), conductive busses 102/102A, grounding buss 103, gripping fingers 121 and 131 act to hold the power plug firmly in place. In FIG. 1C, an upper 110A and lower 110 portion are depicted. Both the upper 110A and lower 110 portions are configured such that they can clasp onto the hot and neutral prongs through the use of two sets of three opposite facing gripping fingers 121. Alternatively there may be two sets of two opposite facing gripping prongs. In some embodiments, the upper 110A and lower 110 portions are connected by way of a break away tab 111. This break away tab 111 can be broken off, where two separate circuits are used to supply electrical power, one circuit supplying power to the upper receptacle, and another circuit supplying power to the lower receptacle. The power from these circuits is supplied via wires that are secured to the conductive busses 102/102A through the use of two (2) sets of four (4) terminal screws 105, and one grounding screw 106 FIG. 1A. Typically there are two terminal screws 105 for the conducting buss 102, two for conducting buss 102A, and one grounding screw 106 for the grounding buss 103. In some embodiments, these screws are color coded brass- or gold-color for the sockets screws 105 corresponding to the hot conductive busses 102, silver for the terminal screws 105 corresponding to the neutral conductive buss 102A, and green for the grounding screw 106 attached to the grounding buss tab 130 FIG. 1A. In some embodiments, the conductive busses 102/102A and grounding screw 106 FIG. 1A are constructed from brass.

Figure 1D:
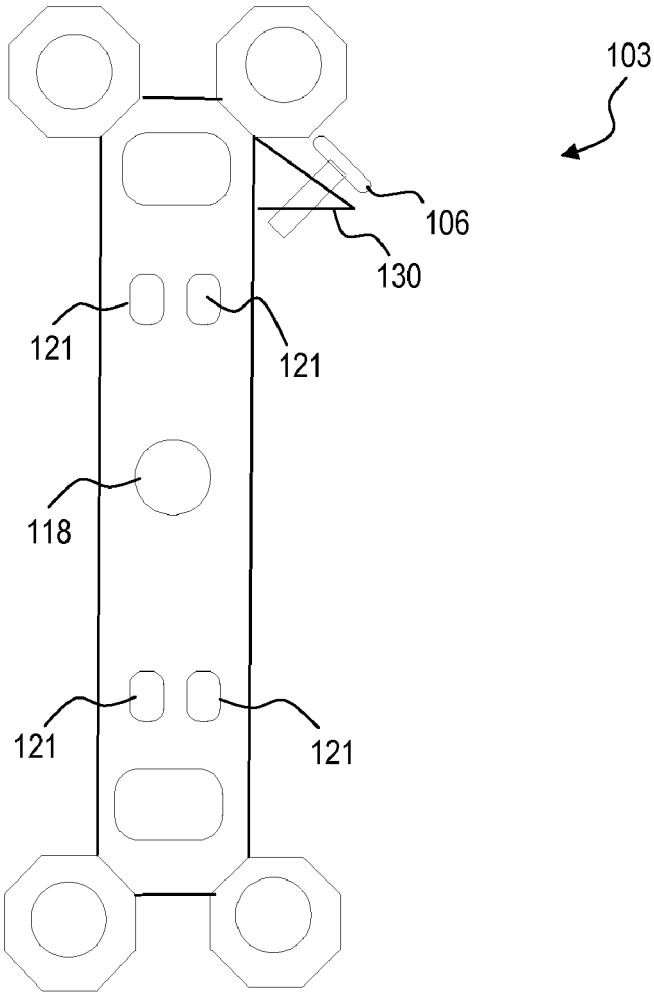
FIG. 1D is a plan view of a ground buss 103 that is part of the prior-art apparatus 100 with a grounding screw 106, a ground tab 130, and a screw opening 118.

The grounding buss 103 depicted in FIG. 1D, in some embodiments, is a part of an apparatus 100. As with the conductive busses 102/102A, the grounding buss 103 contains ground prongs 131 which can either be extruded from ground bus 103 or fastened to ground bus 103 (e.g., by rivets) and are configured so as to clasp onto the plug ground prong, when this prong is inserted. The ground buss 103 clasps onto the plug ground prong through the use of two (2) sets of two opposite facing gripping fingers 131. These gripping fingers 131 are, in turn, connected to the grounding buss 103. In some embodiments, the grounding buss 103 is constructed from brass-plated steel. Further depicted are a grounding screw 106, a ground tab 130 and a screw opening 118.

Figure 1E:
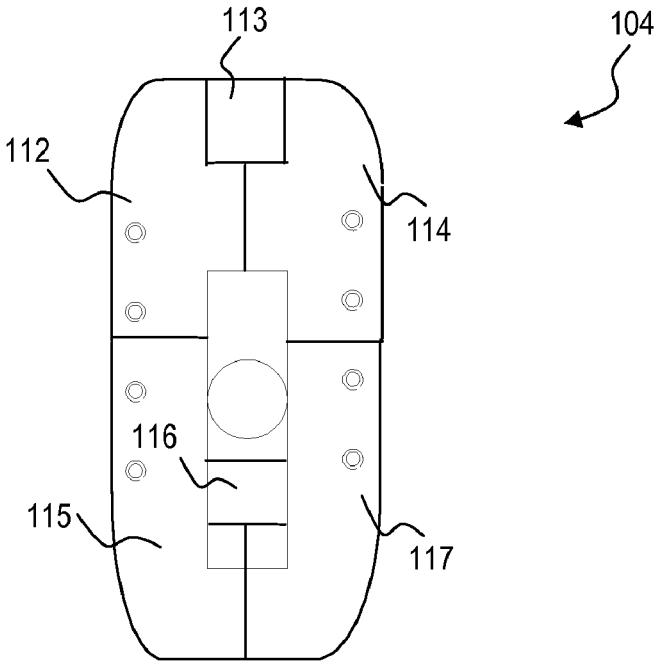
FIG. 1E is a plan view of a body 104 for prior-art apparatus 100, with various isolating compartments (reference numbers 112, 113, 114, 115, 116, 117) within which hot and neutral conducting busses and gripping fingers reside.

The body 104 is depicted in FIG. 1E for the apparatus 100. The conductive busses 102/102A are contained within four (4) compartments or pockets molded into the body 104. Each of the conductive busses 102/102A is positioned to one side of the body 104, such that the first side (left in the figure) of the body will have conducting buss 102 and terminal screws 105, while the second side (right in the figure) will have conducting buss 102A and terminal screws 105. This body 104 is typically divided up into six (6) compartments (i.e., three (3) compartments for each power receptacle). All six (6) compartments allow for each of the six (6) sockets to be isolated from one another. By isolating each of the sockets, the risk of an electrical short and resulting fire is substantially reduced. Accordingly, FIG. 1E illustrates various isolating compartments within which various conductive busses and associated power supply busses and gripping fingers reside that couple to the hot, neutral, ground prongs. These are compartments are numbered 112, 113, 114, 115, 116, 117. In some embodiments, the body 104 is constructed from nylon or other suitable insulator material.

The present invention provides duplex three-prong A.C. receptacle outlets that make specific improvements to receptacle design in comparison to historically problematic areas, which are uniquely designed to allow two larger-than-standard plugs, or plugs with their electrical cords arranged at 90 degrees to the plug (where the cord leaves the plug parallel to the wall towards the ground-socket end of the receptacle), to be plugged in to one duplex outlet at the same time. This result is not possible with a conventional receptacle, since the larger transformers or plugs inserted into one receptacle block use of the other receptacle. In the duplex arrangement described by the present invention, the receptacles are arranged in an opposing or reverse orientation, one to the other, in contrast to using the same orientation as with a conventional receptacle. Each receptacle contains a hot slot, a hot-wire-reception screw, a neutral slot, a neutral-wire-reception screw, a ground socket, a ground-wire-reception screw (which is shared, in some embodiments) and a grounded mounting plate. The hot slots and the neutral slots arranged in reverse directions (left-to-right vs. right-to-left) in the upper relative to the lower outlet, and the ground sockets are in opposite orientations (at the top for the upper receptacle, and at the bottom for the lower receptacle). In some embodiments, the standard orientation (i.e., substantially identical that of a conventional receptacle) of wire-reception screws is maintained for maintaining convention and for safety reasons. In some embodiments, the hot-wire-reception screws are arranged such that both are on the same side of the receptacle in near proximity to one of the sockets they service. Likewise, both neutral wire reception screws are arranged on the same side of the receptacle, opposite that of the hot-wire-reception screws. The electrical polarities are kept apart to avoid short circuit of hot to neutral. In order to support the reversed contact orientation of the outlets, the internal routing of the electrical busses provide connections that cross the receptacle for one or the other receptacle. In some embodiments, the present invention acknowledges and provides a method, apparatus, and means for addressing the aforementioned problem including allowing for two large power plugs, transformers, or converters, or two plugs with their cords at 90 degrees to the plug or any combination of these to be configured in a stacked arrangement. The present invention, in some embodiments, also provides an apparatus, method and means for plugging in standard power plugs (i.e., those with only two prongs) in a stacked, duplex power receptacle arrangement.

Figure 2A:
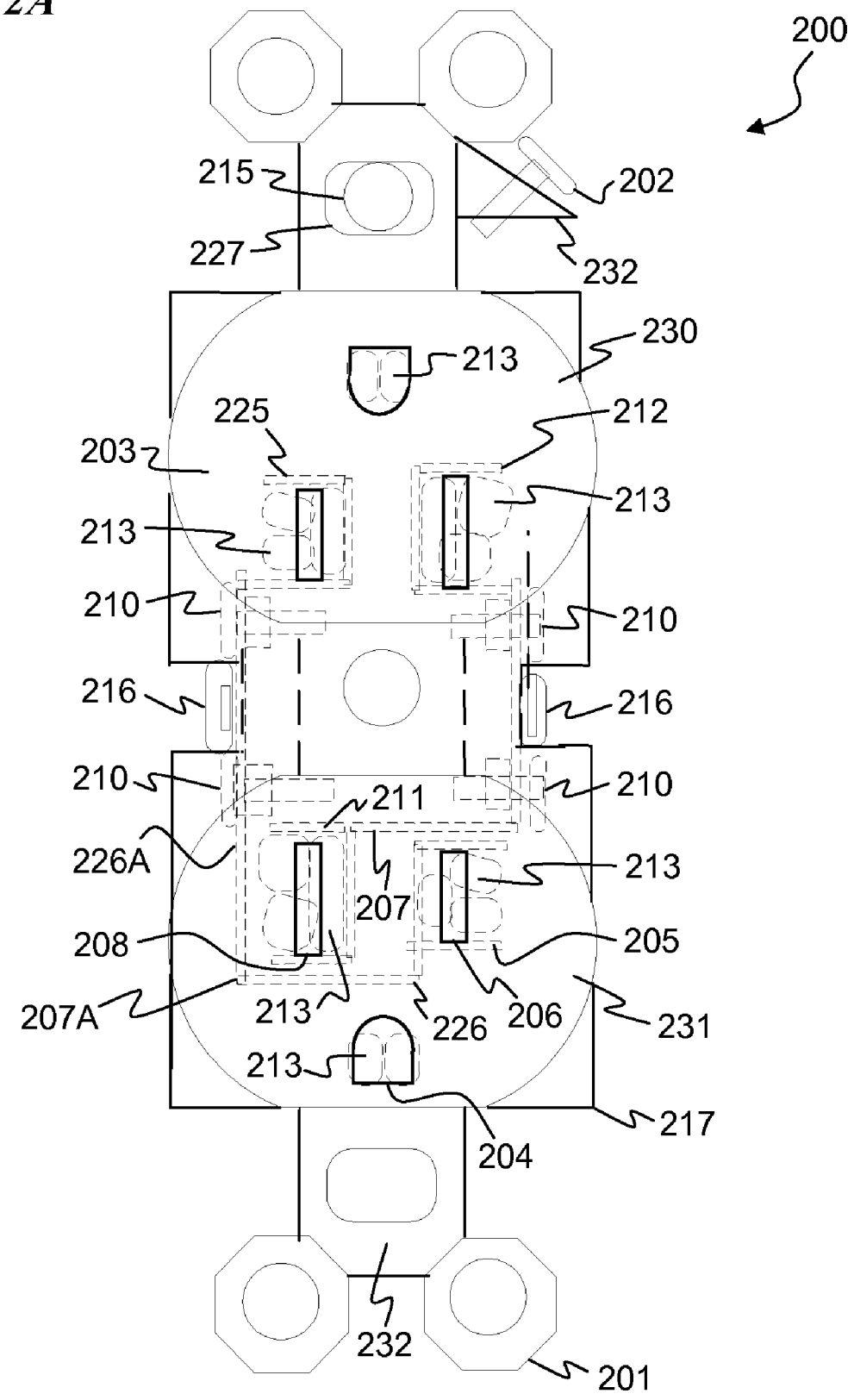
FIG. 2A is a plan view of an apparatus 200 according to some embodiments of the present invention, a ground up/ground down (grounds-out) A.C. power receptacle, with a yoke 201, grounding screw 202, receptacle face 203, prong openings 204, 206, 208, power supply busses 207/207A/207, an upper portion 225212, an lower portion 205, and again, an upper portion 212225, and lower portion 211. Contained in each one of these portions is a series of gripping fingers 213. Additionally depicted is a break-away tab 216.

"Stacked" is a relative term indicating a vertical installation (as shown in the figures). Any of the embodiments shown and described may be, installed horizontally without impacting their ability to service the described plug arrangements. In some embodiments, the above described problem of not being able to connect more than one large power plug is solved by changing the locations of the hot, neutral and ground sockets of the upper power receptacle such that these sockets are configured to be the reverse of the socket configuration disclosed by the bottom power receptacle. In this configuration, the ground sockets are located in the upper most and lower most positions of each individual power receptacle in the duplex power receptacle configuration. Moreover, in some embodiments, the hot and neutral sockets of the upper power receptacle are the reverse of the lower power receptacle such that the neutral socket of the upper power receptacle is located above the hot socket of the lower power receptacle, and the hot socket of the upper power receptacle is located above the neutral socket of the lower power receptacle. Put another way, in some embodiments, the hot socket and neutral socket of the lower power receptacle are located in the opposite location of the upper power receptacle in the duplex power receptacle. In some embodiments, the present invention maintains many of the characteristics of the conventional duplex power receptacle. For example, the conductive busses are positioned on the same side of the apparatus, as in the conventional duplex power receptacle of FIG. 1A. This allows persons installing this apparatus to not have to deviate from the standard and/or conventional installation protocols. Put another way, by maintaining the conductive busses on the same side of the apparatus as the common power receptacle, no new installation training is required to install and, no new wiring procedure need be learned. FIG. 2A is a plan view of an apparatus 200 ground-up/ground-down A.C. power receptacle. Depicted within this illustration is a yoke 201, grounding screw 202, receptacle face 203, prong openings 204, 206, 208, power supply busses 207/207A, conductive busses 226/226A, a lower portion 211205, an upper portion 212, and again, an lower portion 205211, and upper portion 225. Additionally, disclosed is a ground buss 232. Contained in each one of these upper and lower portions (i.e., reference numbers 205, 211, 212, 225) is a series of gripping fingers 213. Additionally depicted are break away tabs 216, and four (4) terminal screws 210. Further, in some embodiments, a clamp nut 215 and accompanying opening 227 are disclosed. Many of these components are well know in the art. In some embodiments, one or more electrical circuits are operatively coupled to the conductive busses 226/226A in a manner that is known in the art. One or more hot wires, color coded with black insulation within the art, are affixed to a first side of the duplex power receptacle with the brass-colored terminal screws located on the first side of the apparatus. One or more neutral wires, color coded with white insulation within the art, are affixed to a second side (opposite the first side) of the duplex power receptacle with the silver-colored terminal screws located on the second side of the apparatus. One or more ground wires, color coded with green insulation or with no insulation (i.e., bare copper wire) within the art, are affixed to the second side of the duplex power receptacle, typically with a green-colored terminal screw located on the second side of the apparatus. Having neutral on the same side as the ground tab reduces problems if they were to accidentally short to one another. The hot terminal screws 210 are typically color coded as gold within the art. The neutral wire is typically color coded as a white wire within the art, and it is attached to the silver terminal screws 210 located on the second side of the apparatus. The green or bare ground circuit wire is typically attached to the green grounding screw 202 on the second, neutral side, as is known in the art.

Once the apparatus 200 is operative coupled to an electrical circuit, as described above, the power receptacles (i.e., lower 230 and upper 231) are free to be used to provide electrical power to a power plug. Given the ground-up orientation of the upper power receptacle 231, one may use more than one large power plug containing a transformer and/or converter.

In some embodiments, the apparatus 200 shares some of its attributes with the conventional duplex power outlet disclosed in FIGS. 1A-1E. The apparatus 200 discloses two (2) break-away tabs 216 to allow for this duplex power outlet to be supplied electrical power by two (2) as opposed to one (1) electrical power circuit. Specifically, when the tab is broken, for example, using a screw driver, the conductive buss 226 or 226A is separated into two portions, a lower portion 205, 211 and an upper portion 212, 225. Once the tab is broken into two, each lower portion (i.e., reference numbers 205 and 211) can be supplied electrical power from a circuit distinct from the upper portions (i.e., reference numbers 212, 225). The material(s) used in the manufacture of apparatus 200 is described above under FIGS. 1A-1E.

In some embodiments, the apparatus 200 is distinct from conventional duplex power outlets, such as those disclosed in FIGS. 1A-1E, by virtue of the orientation of the prong openings (i.e., reference numbers 204, 206, and 208), and the conductive busses 226/226A. Specifically, the orientation of prong openings are such that this duplex power outlet can accommodate two three-prong power plugs each having a transformer and/or converter attached. More to the point, in some embodiments, the prong opening 206 is oriented to be on the opposite side of the more conventional power receptacle as depicted in FIGS. 1A-1E. Again, the prong opening 208 (i.e., the neutral prong opening) is on the opposite side, as is described in FIGS. 1A-1E. Moreover, the orientation of the opening for the ground prong (i.e., No. 204) is in a ground-down configuration such that the base of the semi-circular opening that makes up the ground prong opening 204 is facing down as opposed to up, as is the case with the conventional duplex power outlet depicted in FIGS. 1A-1E.

Figure 2B:
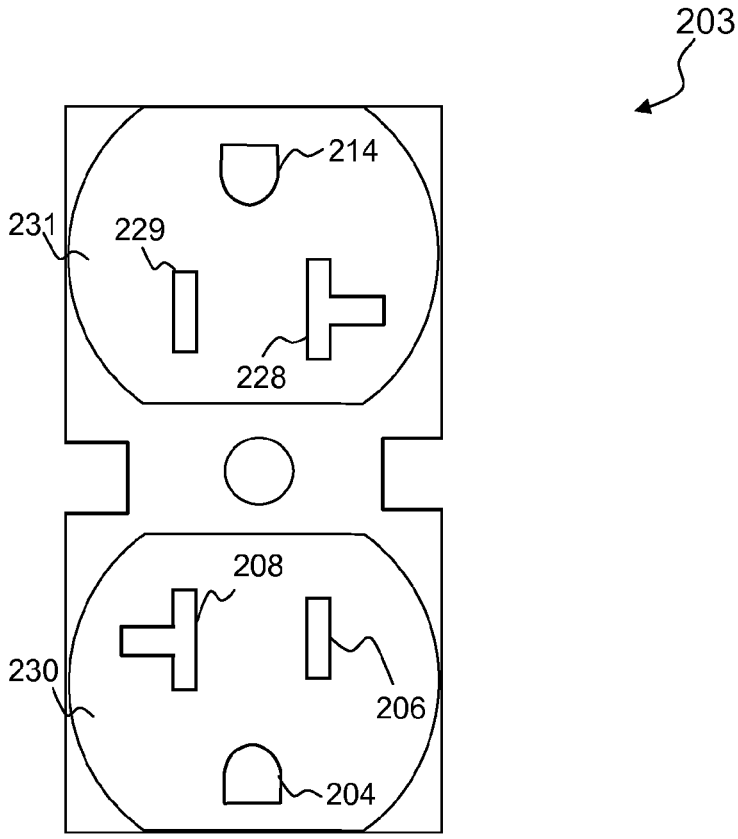
FIG. 2B is a plan view of an apparatus 200 receptacle face 203.

FIG. 2B is a plan view of an apparatus 200 receptacle face 203. In the illustration, the lower power receptacle 230 discloses hot and neutral prong openings (i.e., reference numbers 206, 208) that are oriented in a manner opposite that of the upper, more common, power receptacle 231. Moreover, the opening for the ground prong 204 is oriented in a manner described above as a ground-down configuration. The upper power receptacle 231 discloses a neutral prong opening 228, hot prong opening 229 and a ground prong opening 214, in a ground-up configuration.

Figure 2C:
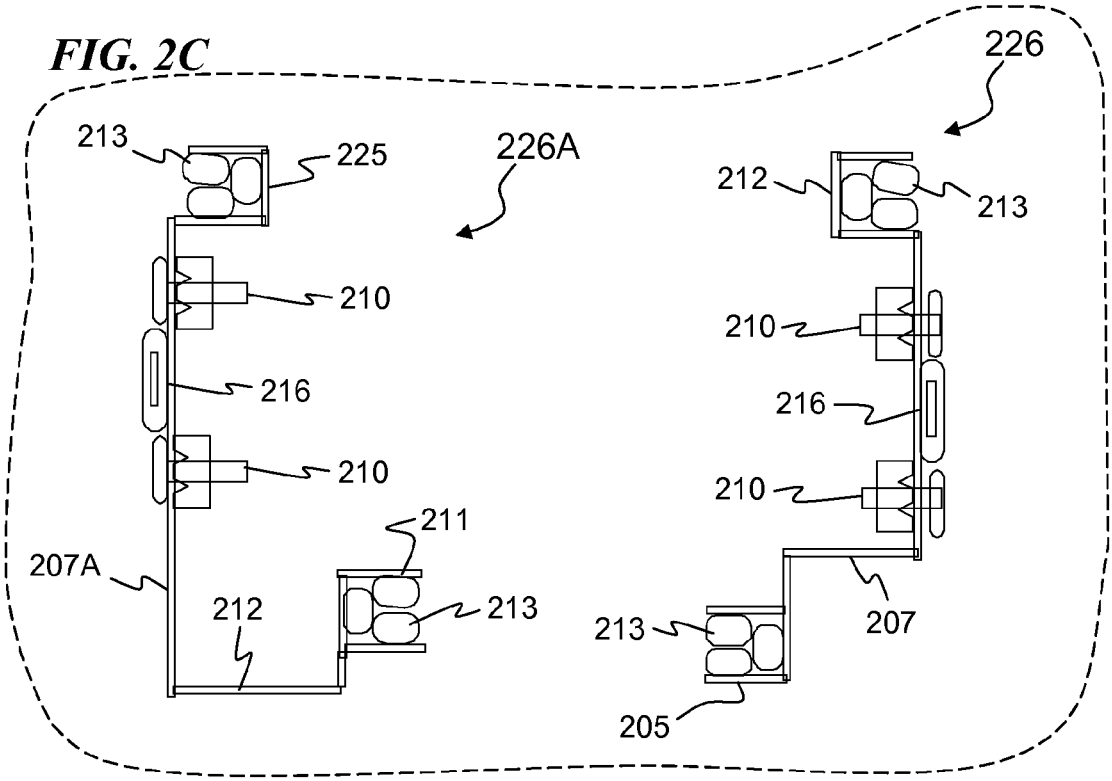
FIG. 2C and FIG. 2D are a plan view and an elevational end view, respectively, of conductive busses 226A and 226 of an apparatus 200.
Figure 2D:
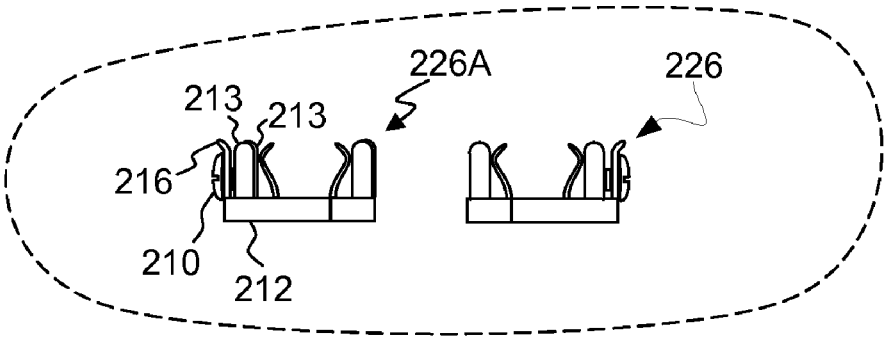

FIG. 2C and FIG. 2D are a plan view and an elevational end view, respectively, of conductive busses 226A and 226 of an apparatus 200. Conducting buss 226 corresponds to the neutral prong openings 208 and 228. The conductive buss 226 has a power-supply bus 207, gripping fingers 213, terminal screws 210, break away tab 216, and lower portion 211 and upper portion 212. Similarly, conductive buss 226A has a power supply bus 207A, gripping fingers 213, terminal screws 210, break away tab 216, and lower portion 205 and upper portion 212.

In some embodiments, FIG. 2C provides the configuration of the power conductive busses 226/226A. Distinct from the conventional duplex power receptacles disclosed in FIGS. 1A-1E, the power supply busses disclosed in FIG. 2B traverse the receptacle face of the lower power receptacle 230 such that the prong openings (e.g., reference numbers 204, 206, 208) can be placed in an orientation that is the reverse of the lower power receptacles described in FIGS. 1A-1E. That is, rather than the conventional arrangement having the neutral slots both being located on the same side of the duplex power receptacle, and the hot slots both being located on the opposite side, in some embodiments, the current invention places the neutral slot of the upper power receptacle 230 on one side of the upper power receptacle, but has the neutral slot of the lower power receptacle 231 on the other side. Likewise the hot slots 206 and 229 are on opposite sides. This places the ground socket 204 of the of the upper power receptacle in the ground-up position and the ground prong socket 214 of the lower power receptacle in the ground-down position.

Figure 2E:
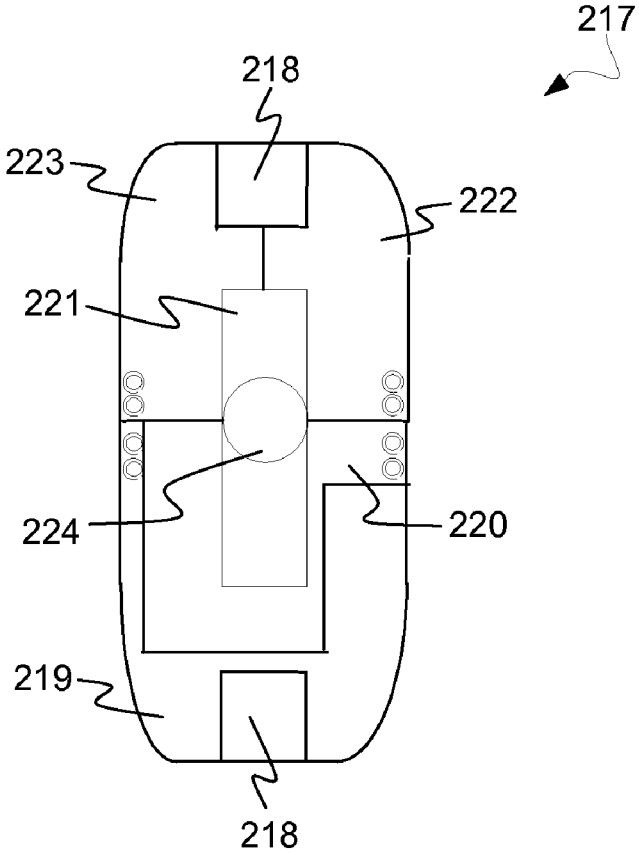
FIG. 2E is a plan view of the body 217 of an apparatus 200 containing various compartments (reference numbers 218, 219, 220, 221, 222, and 223) used to isolate hot and neutral conductive busses and gripping fingers.

FIG. 2E is a plan view of the body 217 of an apparatus 200. In some embodiments, contained within this body 217 are various compartments used to isolate the various conductive busses, power supply busses and gripping fingers. In some embodiments, these compartments (reference numbers 218, 219, 220, 221, 222, and 223) are molded into the body 217. Compartment 218 provides an isolated area for the gripping fingers that attach to both the ground buss 232 and operatively couple to the ground prong, when the power plug is inserted into the power receptacle. Compartment 219 provides an isolated area for the upper portion of conducting buss 226A and its associated gripping fingers 213. Compartment 220 provides an isolated area for the lower portion 205 of conducting buss 226 and its associated gripping fingers 213. Compartment 221 provides an isolated area for a second set of gripping fingers that attach to both the ground buss 232 and operatively couple to the ground prong, when the power plug is inserted into the power receptacle. Compartment 222 provides an isolated area for the lower portion 212 of conducting buss 226 and its associated gripping fingers 213. Compartment 223 provides an isolated area for upper portion 225 for conducting buss 226A and its associated gripping fingers 213. Additionally, an opening 224 for a screw to affix a standard cover plate is shown.

Figure 3:
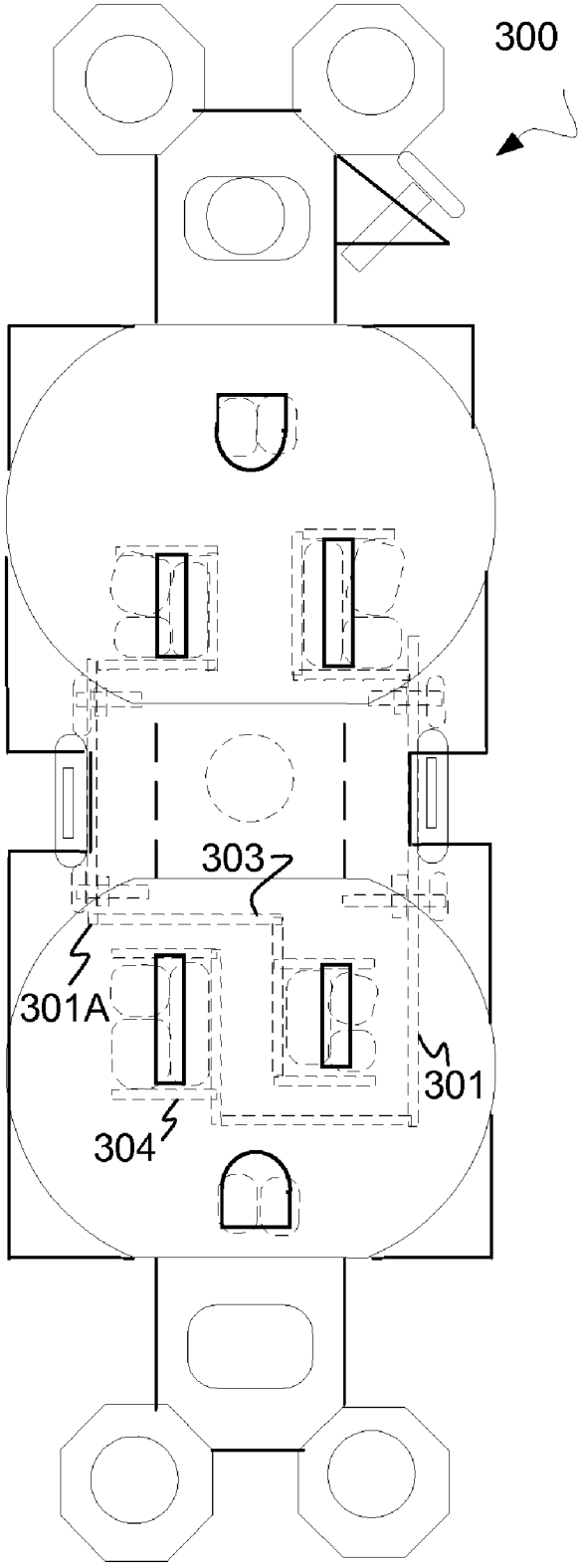
FIG. 3 is a plan view of an apparatus 300 that has conducting busses 301 and 301A oriented in slightly different position such that power supply busses 303 and 304 are in different positions as compared to FIG. 2A.

The body 217 disclosed in FIG. 2D is configured such that conductive buss 226 is oriented above conductive buss 226A. As disclosed elsewhere, the purpose of providing isolated compartments for each conductive buss, power supply bus or prong is to prevent or lessen the likelihood that an electrical short could occur from the hot conductive buss to the neutral conductive buss or to the ground buss resulting in short circuit and potential fire hazard. These problems, and dangers arising there from, are well known in the art. In some embodiments, conducting buss 226, however, could be oriented below conducting buss 226A. FIG. 3 shows such a configuration.

FIG. 3 is a plan view of an apparatus 300 that has conductive busses 301 and 301A oriented in slightly different position such that power supply busses 303 and 304 are in different positions as compared to FIG. 2A. Specifically, as compared to FIG. 2A, the power supply bus 303 of conductive buss 301A is oriented above that of conducting buss 301 and power supply bus 304. The material(s) used in the manufacture of 300 apparatus is described above under FIGS. 1A-1E. Through empirical testing it can be determined whether the conductive buss orientation (i.e., reference numbers 226/226A, 301/301A) of FIG. 2A or FIG. 3 is more effective.

Figure 4:
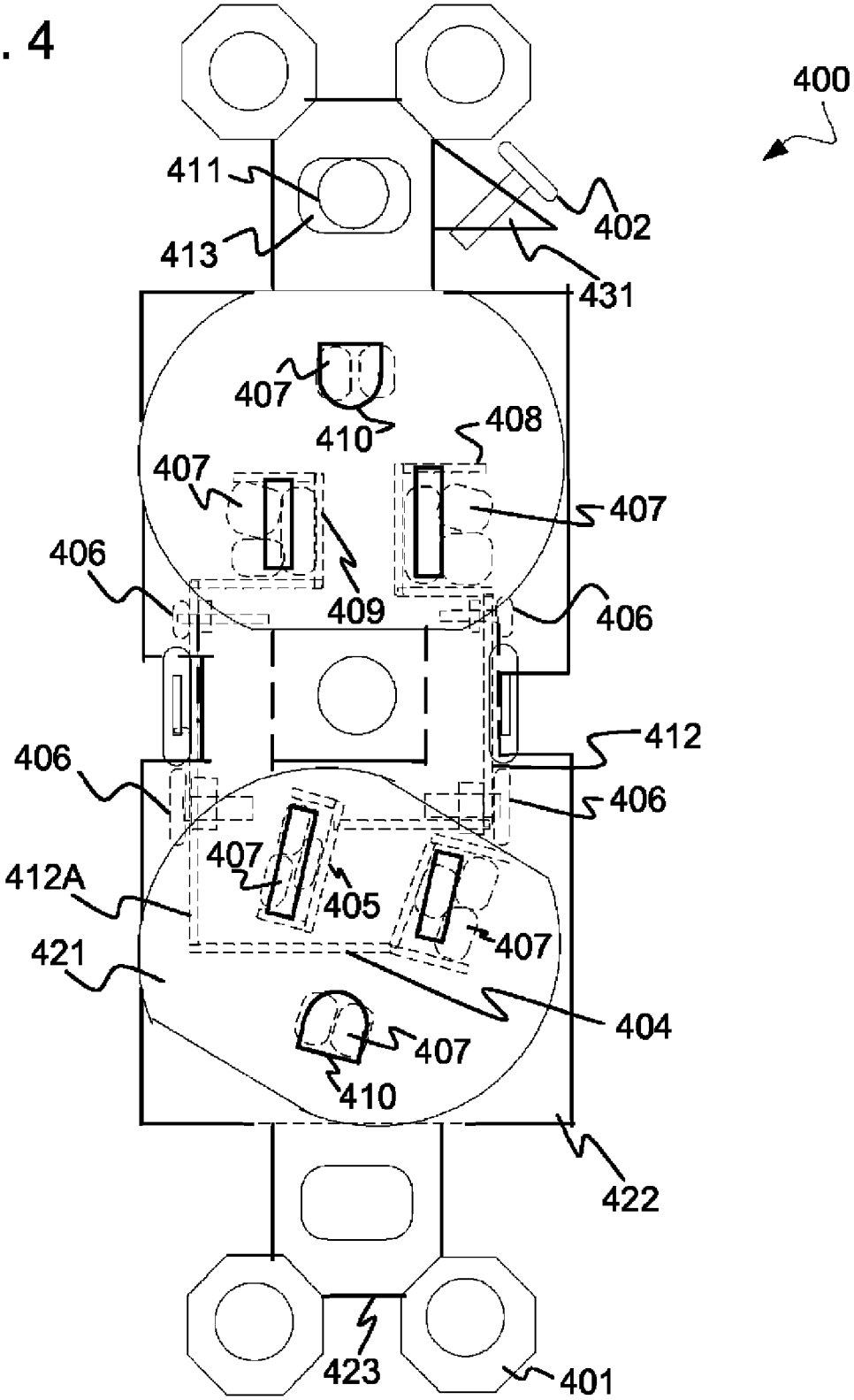
FIG. 4 is a plan view of an apparatus 400 that has the lower power receptacle 421 oriented at a slant or angle relative to the upper power receptacle 422 with conducting busses 412 and 412A that possess angled lower portions 404 and 405 that correspond to the angled nature of the receptacle face 403, and the accompanying ground prong 410.

FIG. 4 is a plan view of an apparatus 400 that has the lower power receptacle 421 oriented at some angle to the upper power receptacle 422. Relative to the upper receptacle, in some embodiments, the lower power receptacle 421 is oriented at a 45 degree angle. In some embodiments, the lower power receptacle 421 is oriented about at a 05 degree angle. In some embodiments, the lower power receptacle 421 is oriented about at a 10 degree angle. In some embodiments, the lower power receptacle 421 is oriented about at a 15 degree angle. In some embodiments, the lower power receptacle 421 is oriented about at a 20 degree angle. In some embodiments, the lower power receptacle 421 is oriented about at a 25 degree angle. In some embodiments, the lower power receptacle 421 is oriented about at a 30 degree angle. In some embodiments, the lower power receptacle 421 is oriented about at a 35 degree angle. In some embodiments, the lower power receptacle 421 is oriented about at a 40 degree angle. In some embodiments, the lower power receptacle 421 is oriented about at a 50 degree angle. In some embodiments, the lower power receptacle 421 is oriented about at a 55 degree angle. In some embodiments, the lower power receptacle 421 is oriented about at a 60 degree angle. In some embodiments, the lower power receptacle 421 is oriented about at a 65 degree angle. In some embodiments, the lower power receptacle 421 is oriented about at a 70 degree angle. In some embodiments, the lower power receptacle 421 is oriented about at a 75 degree angle. In some embodiments, the lower power receptacle 421 is oriented about at an 80 degree angle. In some embodiments, the lower power receptacle 421 is oriented about at an 85 degree angle. In some embodiments, the lower power receptacle 421 is oriented about at a 90 degree angle. This orientation can be to the left or to the right such that the bottom-up position of the grounding socket opening is moved to the left or right relative to the left or right side of the apparatus as the apparatus is viewed from the front receptacle face side. Additionally depicted in FIG. 4 are four (4) terminal screws 406, conducting busses 412/412A, gripping fingers 407, ground socket openings 410, grounding screw 402, yoke 401, receptacle face 403, clamp nut 411, grounding buss 423, ground tab 431 and clamp nut opening 413. Likewise receptacle 422 may be oriented as described above relative to receptacle 421. The effectiveness of one angle verses another can be determined empirically using, among other things, various power plugs with transformers and/or converters as are known in the art. In some embodiments, the material(s) used in the manufacture of 400 apparatus is described above under FIGS. 1A-1E.

In some embodiments, it might be more advantageous to configure a lower power receptacle 421 such that it is at an angle other than 90 degrees to the upper power receptacle 422. Again, in some embodiments, this determination could be based upon empirical testing of the relative effectiveness of orienting the upper power receptacle to one angle verses another.

In some embodiments, both lower portions (i.e., reference numbers 404, 405) and upper portions (i.e., reference numbers 408, 409) of the conductive busses have four (4) sets of three (3) gripping fingers 407. Additionally, depicted are two (2) break away tabs 421.

As shown above in the discussion regarding FIG. 3, in some embodiments, conductive buss 412 is oriented below the conducting buss 412A. The relative advantages of such an orientation are, in some embodiments, determined through the empirical testing and/or modeling of one orientation verses another. In some embodiments, body 422 possesses various isolating compartments within which are contained conductive busses and that are connected to the hot and neutral prongs. These compartments are numbered 414, 415, 416, 417, 418, and 420. Compartment 414 provides an isolated area for the gripping fingers that attach to both the ground buss 423 and operatively couple to the ground prong, when the power plug is inserted into the power receptacle. Compartment 415 provides an isolated area for the lower portion 404 of the conducting buss 412A. Compartment 416 provides an isolated area for the lower portion 405 of the conducting buss 412. Compartment 417 provides an isolated area for the upper portion 408 of conducting buss 412. Compartment 418 provides an isolated area for upper portion 409 for conducting buss 412A. Compartment 420 provides an isolated area for a second set of gripping fingers that attach to both the ground buss 423 and operatively couple to the ground prong, when the power plug is inserted into the power receptacle. Additionally, an opening 419 is for a screw to affix a standard cover plate. In some embodiments, the organization of the body 422 will vary based upon the orientation of the conductive busses 412/412A. Specifically, in some embodiments, orienting conductive buss 412 below 412A will result in a different organization of the isolating compartments such that each conductive buss is isolated from the other conductive buss and from the grounding buss and associated gripping fingers 407. While FIG. 4C assumes an orientation where conductive buss 412 is positioned above conductive buss 412A, other embodiments are envisioned.

Figure 5:
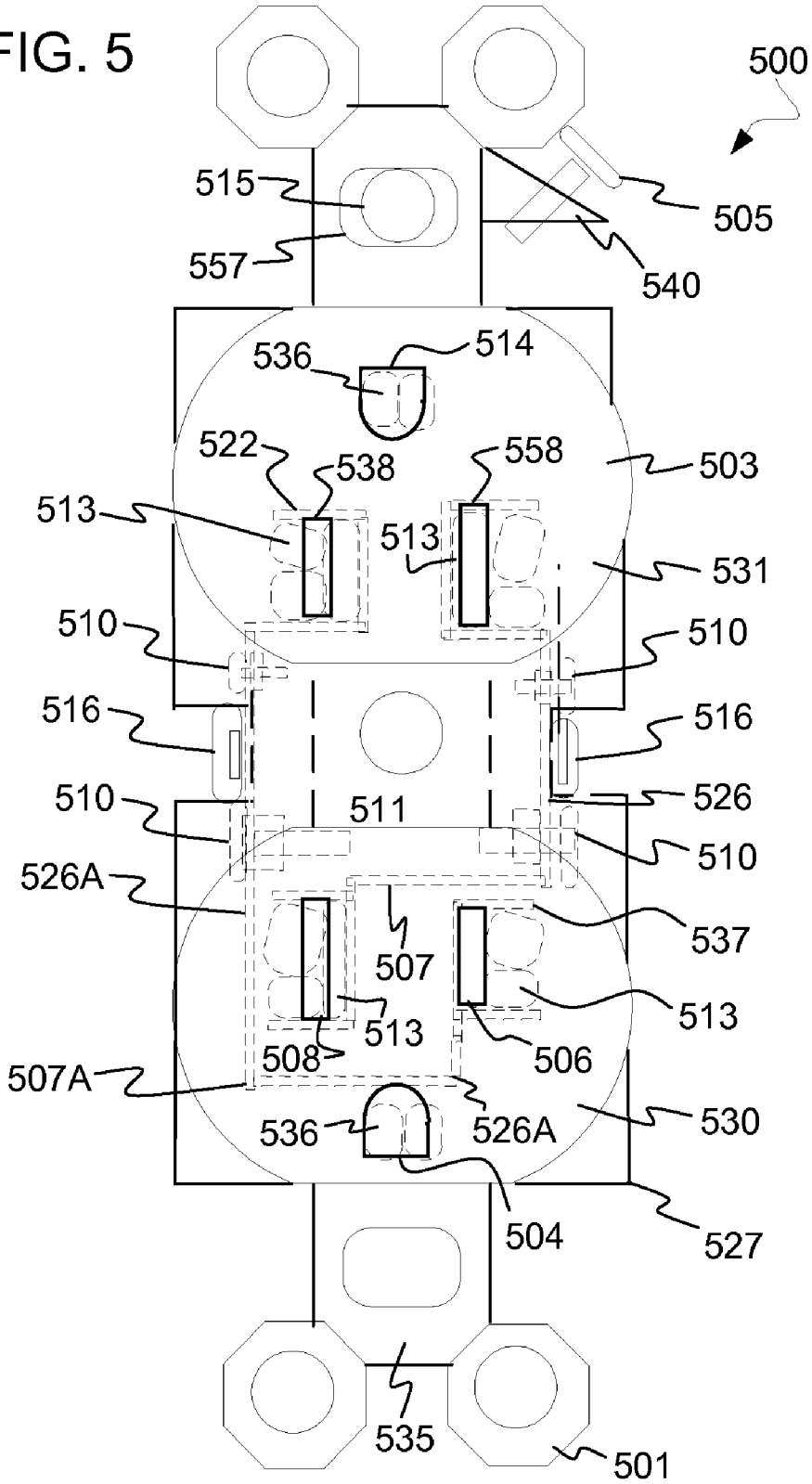
FIG. 5 is a plan view showing the structure of apparatus 500.

FIG. 5 is an illustration showing the configuration and structure of a ground-up/ground-down duplex power outlet apparatus 500 according to some embodiments of the invention. Apparatus 500 includes yoke 501 that allows the ground-up/ground-down duplex power outlet to be attached to a standard wall box as is known in the art. A grounding buss 535, ground tab 531, and grounding screw 505 are attached to the backside of the apparatus 500, with the grounding screw 505 and ground tab 531 providing a structure to accept a grounding wire as in known and understood in the art. Attached to the grounding buss 535 are two (2) sets of grounding gripping fingers 536 providing a structure to secure a ground prong of a three-prong power plug, as is known in the art. Further, in some embodiments, a clamp nut 515 and accompanying opening 557 are disclosed that allow for an additional structure to secure the duplex power outlet to a standard wall box.

Attached to the grounding buss 535 of apparatus 500, via a fastening means such as a rivet, screw, or adhesive, is a body 527. Molded into this body 527 are various compartments used to isolate the various conducting busses, power supply busses and gripping fingers that correspond to hot, neutral and ground prongs. These compartments are numbers 518, 519, 550, 551, 555, and 553. Compartment 518 provides an isolated area for the gripping prongs 536 that attach to both the ground buss 535 and operatively couple to the ground prong of the plug when the power plug is inserted into the power receptacle. Compartment 519 provides an isolated area for the lower portion of conducting buss 526A, its associated gripping fingers 513, and provides a structure for securing the hot prong when a power plug is inserted into the power receptacle. Compartment 550 provides an isolated area for the lower portion 537 of conducting buss 526, its associated prong 513, and provides a structure to secure the neutral prong of the power plug. Compartment 551 provides an isolated area for a second set of gripping prongs 536 that attach to both the ground buss 535 and operatively couple to the ground prong, when the power plug is inserted into the power receptacle. Compartment 555 provides an isolated area for the upper portion 515 of conducting buss 526, its associated gripping prongs 513, and provides a structure that allows for the neutral prong of the power plug to be inserted. Compartment 553 provides an isolated area for upper portion 522 for conducting buss 526A, its associated gripping prongs 513, and provides the necessary structure to allow for the hot prong to be inserted into the apparatus 500. Additionally, an opening 554 is for a screw to affix an outlet cover plate.

Inserted into the body 527 of apparatus 500 and the compartments disclosed therein are conductive busses 526, and 526A. Conductive buss 526 corresponds to the neutral prong openings 508 and 558. The conductive buss 526 has a power supply bus 507, gripping prongs 513, two (2) terminal screws 510, break-away tab 516, a lower portion 511 and an upper portion 515. Similarly, conductive buss 526A has a power supply bus 507A, gripping prongs 513, two (2) terminal screws 510, break-away tab 516, a lower portion 537 and an upper portion 522. Conductive buss 226A corresponds to the hot prong openings 506 and 538.

Attached over the body 527 of apparatus 500 is a receptacle face 503. Contained within this receptacle face are the openings for an upper power receptacle 530 disclosing hot and neutral prong openings (i.e., reference numbers 506, 508) that are oriented in a manner opposite that of the upper, conventional, power receptacle 531. Moreover, the opening for the ground prong 504 is oriented in a manner described above as a ground-down configuration. The upper power receptacle 531 discloses a neutral prong opening 558, hot prong opening 538 and a ground prong opening 514 in a ground-up configuration. This receptacle face is secured to the body 527 via fastening means such as a screw, rivet, adhesive, or some other fastening means.

Figure 6:
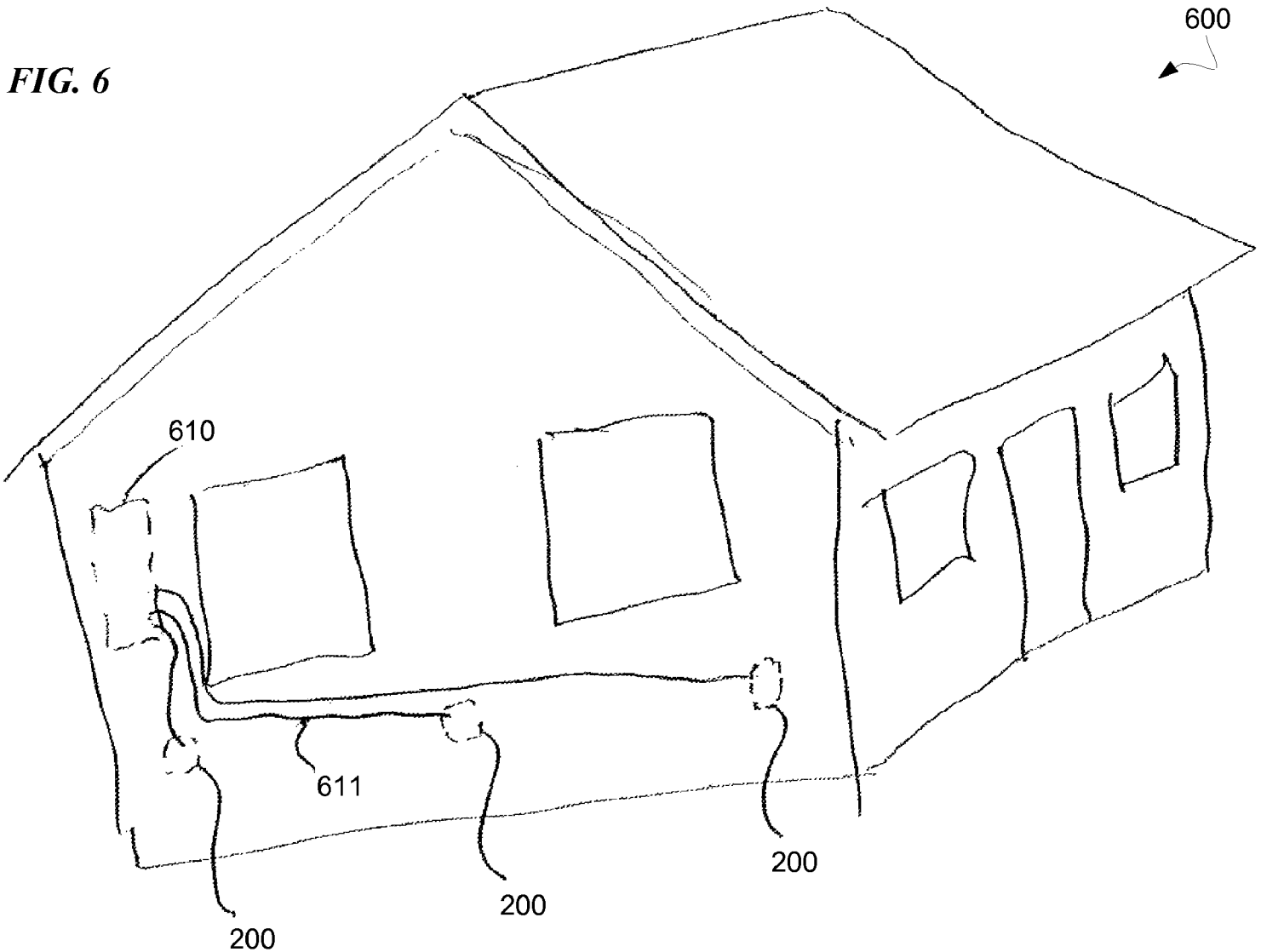
FIG. 6 is a schematic view of a house 600 having one or more outlets of the present invention. In some embodiments, house 600 includes one or more outlets 200, according to the description above. In some embodiments, various combinations of the parts described herein, including faceplates, wiring, and socket configurations are used in combination.

FIG. 6 is a schematic view of a house 600 having one or more outlets of the present invention. In some embodiments, house 600 includes one or more outlets 1200, 200, 300, 400, or 500, according to the descriptions herein. Some embodiments include a residential circuit-breaker box 610 and in-wall wiring 611 connecting between the circuit-breaker box and the outlets.

Figure 7A:
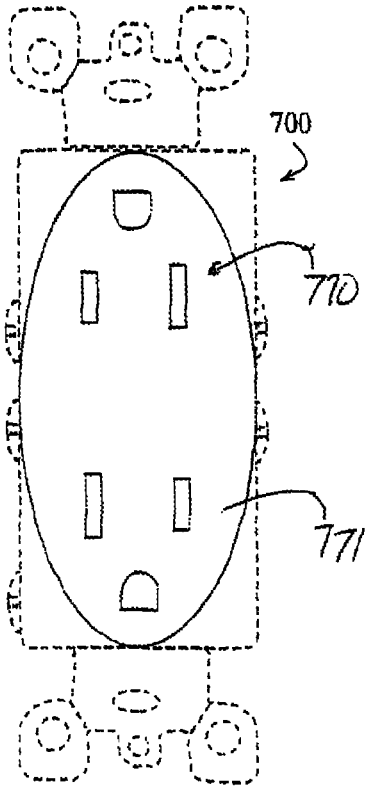
FIG. 7A is a front view of a design of an outlet faceplate 700 of some embodiments of the invention.

FIG. 7A is a front view of a design of an outlet faceplate 700 of some embodiments of the invention. In some embodiments, outlet faceplate 700 has an oval shape that has the same width and height as a conventional Decora™ faceplate, which also has the same overall width and height as a conventional truncated-circle duplex outlet as shown in FIG. 1. In some embodiments, outlet faceplate 700 has a substantially flat front surface, and optionally a small bevel along its circumference. In some embodiments, outlet faceplate 700 has slightly beveled edges and the vertical grounds-out configuration described above. In some embodiments, the vertical grounds-out configuration of receptacle 770 and 771 is not part of the design and are replaced with a different receptacle orientation such as shown in FIG. 9D, 9G, or 9J (and as if they were in dotted-line in this figure).

Figure 7B:
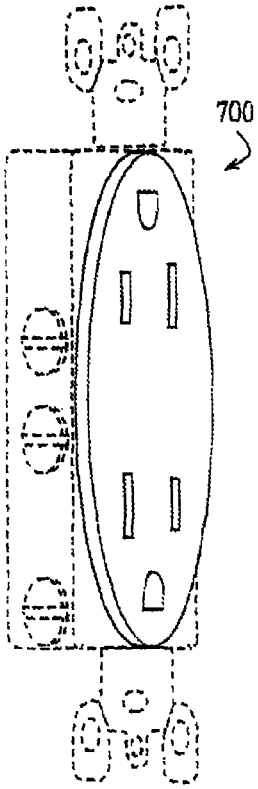
FIG. 7B is a front-side diagonal view of a design of outlet faceplate 700.

FIG. 7B is a front-side diagonal view of a design of outlet faceplate 700.

Figure 7C:
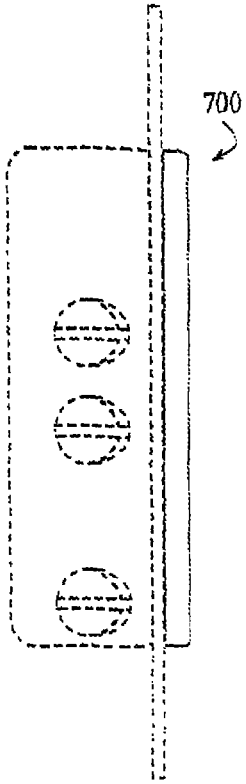
FIG. 7C is a side view of a design of outlet faceplate 700.

FIG. 7C is a side view of a design of outlet faceplate 700.

Figure 7D:
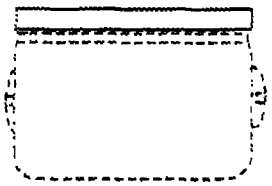
FIG. 7D is a top view of a design of outlet faceplate 700.

FIG. 7D is a top view of a design of outlet faceplate 700.

Figure 7E:
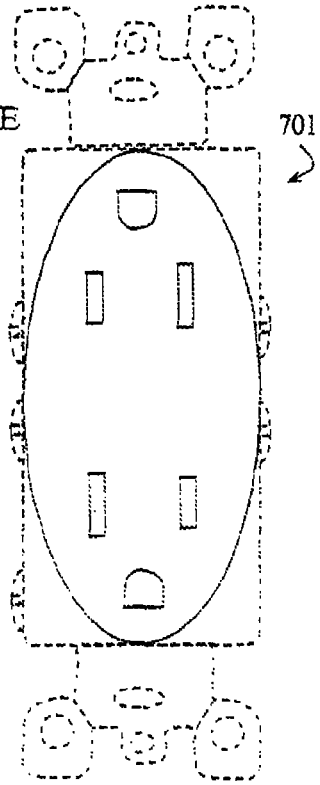
FIG. 7E is a front view of a design of an outlet faceplate 701 of some embodiments of the invention.

FIG. 7E is a front view of a design of an outlet faceplate 701 of some embodiments of the invention. In some embodiments, outlet faceplate 701 has an oval shape that has the same width and height as a conventional Decora™ faceplate, which also has the same overall width and height as a conventional truncated-circle duplex outlet as shown in FIG. 1. In some embodiments, outlet faceplate 701 has a front surface that has a rounded slightly raised side and top profile that is approximately radially symmetric (the cross section at any angle is a stretched version of the top profile, in some embodiments), and optionally has a small bevel along its circumference. In some embodiments, the vertical grounds-out configuration of receptacle 770 and 771 is not part of the design and are replaced with a different receptacle orientation.

Figure 7F:
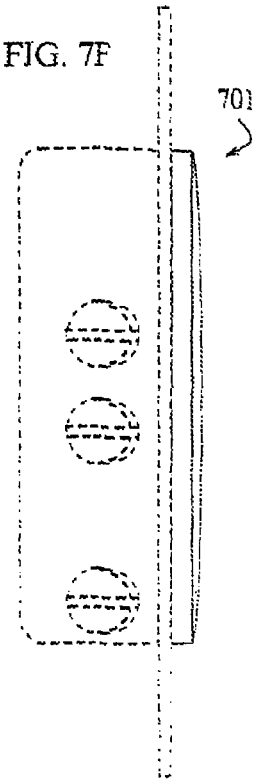
FIG. 7F is a side view of a design of outlet faceplate 701.

FIG. 7F is a side view of a design of outlet faceplate 701.

Figure 7G:
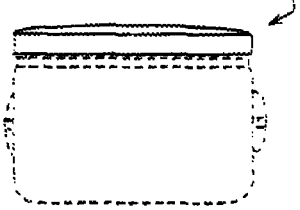
FIG. 7G is a top view of a design of outlet faceplate 701.

FIG. 7G is a top view of a design of outlet faceplate 701.

Figure 7H:
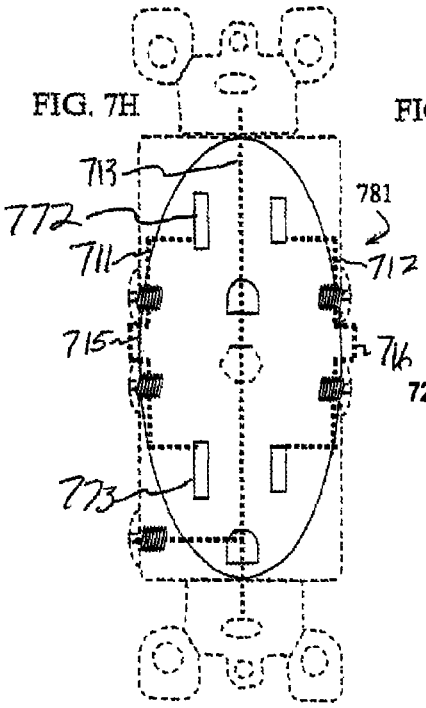
FIG. 7H is a front schematic wiring diagram an outlet back portion 781 of some embodiments of the invention.

FIG. 7H is a front schematic wiring diagram an outlet back portion 781 of some embodiments of the invention. This circuit includes a conventional hot conductive buss 711 that includes a breakaway portion 715, a conventional neutral conductive buss 712 that includes a breakaway portion 716, and a conventional ground conductive buss 713. In some embodiments, outlet back portion 781 has an oval outline and a substantially planar front surface (in some embodiments, this has slightly beveled edges), and the vertical grounds-out configuration described above. In some embodiments, the conventional vertical grounds-down configuration of receptacles 772 and 773 is not part of the design and are replaced with a different receptacle orientation.

Figure 7I:
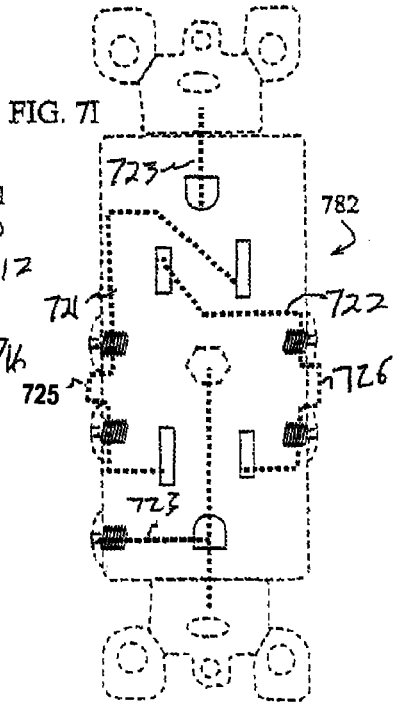
FIG. 7I is a front schematic wiring diagram an outlet back portion 782 of some embodiments of the invention.

FIG. 7I is a front schematic wiring diagram an outlet back portion 782 of some embodiments of the invention. This circuit includes a hot conductive buss 721 that includes a breakaway portion 725, a neutral conductive buss 722 that includes a breakaway portion 726, and a ground conductive buss 723.

Figure 7J:
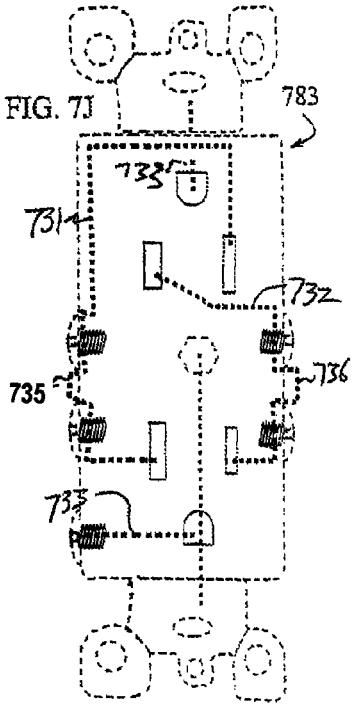
FIG. 7J is a front schematic wiring diagram an outlet back portion 783 of some embodiments of the invention.

FIG. 7J is a front schematic wiring diagram an outlet back portion 783 of some embodiments of the invention. This circuit includes a hot conductive buss 731 that includes a breakaway portion 735, a neutral conductive buss 732 that includes a breakaway portion 736, and a ground conductive buss 733.

Figure 7K:
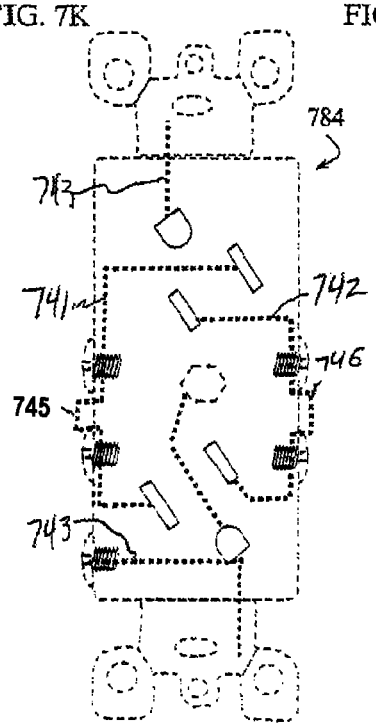
FIG. 7K is a front schematic wiring diagram an outlet back portion 784 of some embodiments of the invention.

FIG. 7K is a front schematic wiring diagram an outlet back portion 784 of some embodiments of the invention. This circuit includes a hot conductive buss 741 that includes a breakaway portion 745, a neutral conductive buss 742 that includes a breakaway portion 746, and a ground conductive buss 743.

Figure 7L:
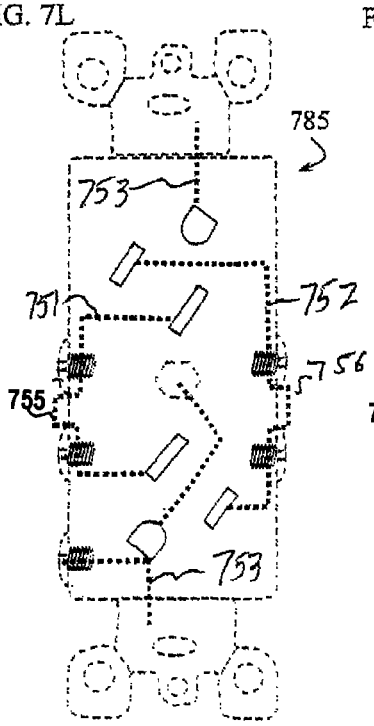
FIG. 7L is a front schematic wiring diagram an outlet back portion 785 of some embodiments of the invention.

FIG. 7L is a front schematic wiring diagram an outlet back portion 785 of some embodiments of the invention. This circuit includes a hot conductive buss 751 that includes a breakaway portion 755, a neutral conductive buss 752 that includes a breakaway portion 756, and a ground conductive buss 753.

Figure 7M:
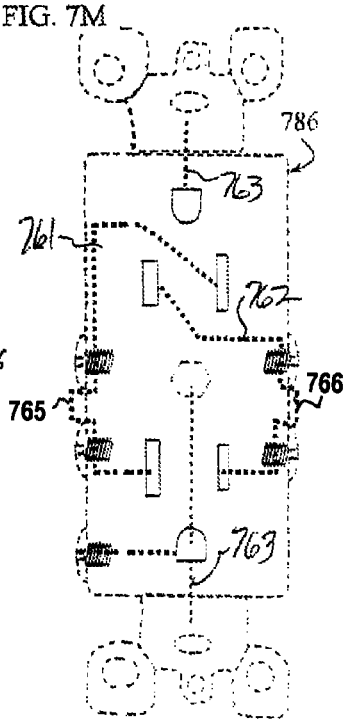
FIG. 7M is a front schematic wiring diagram an outlet back portion 786 of some embodiments of the invention.

FIG. 7M is a front schematic wiring diagram an outlet back portion 786 of some embodiments of the invention. This circuit includes a hot conductive buss 761 that includes a breakaway portion 765, a neutral conductive buss 762 that includes a breakaway portion 766, and a ground conductive buss 763.

Figure 8A:
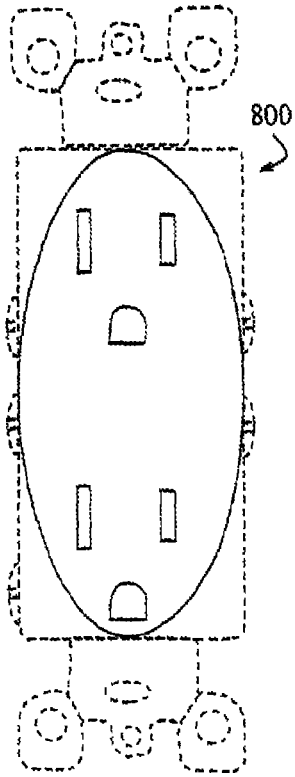
FIG. 8A is a front view of a design of an outlet faceplate 800 of some embodiments of the invention.

FIG. 8A is a front view of a design of an outlet faceplate 800 of some embodiments of the invention. In some embodiments, outlet faceplate 800 has an oval shape that has the same width and height as a conventional Decora™ faceplate, which also has the same overall width and height as a conventional truncated-circle duplex outlet as shown in FIG. 1. In some embodiments, outlet faceplate 800 has a substantially flat front surface, and optionally a small bevel along its circumference.

Figure 8B:
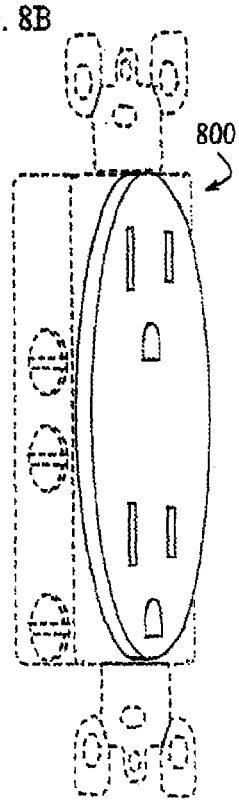
FIG. 8B is a front-side diagonal view of a design of outlet faceplate 800.

FIG. 8B is a front-side diagonal view of a design of outlet faceplate 800.

Figure 8C:
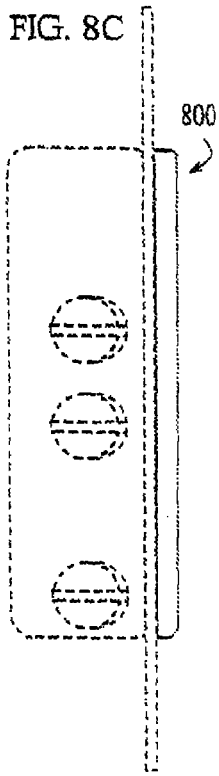
FIG. 8C is a side view of a design of outlet faceplate 800.

FIG. 8C is a side view of a design of outlet faceplate 800.

Figure 8D:
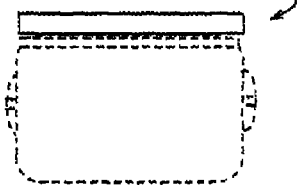
FIG. 8D is a top view of a design of outlet faceplate 800.

FIG. 8D is a top view of a design of outlet faceplate 800.

Figure 8E:
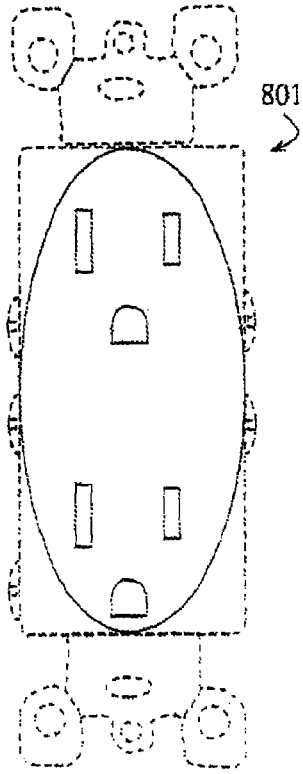
FIG. 8E is a front view of a design of an outlet faceplate 801 of some embodiments of the invention.

FIG. 8E is a front view of a design of an outlet faceplate 801 of some embodiments of the invention. In some embodiments, outlet faceplate 801 has an oval shape that has the same width and height as a conventional Decora™ faceplate, which also has the same overall width and height as a conventional truncated-circle duplex outlet as shown in FIG. 1. In some embodiments, outlet faceplate 801 has a slightly rounded side profile front surface, and optionally a small bevel along its circumference.

Figure 8F:
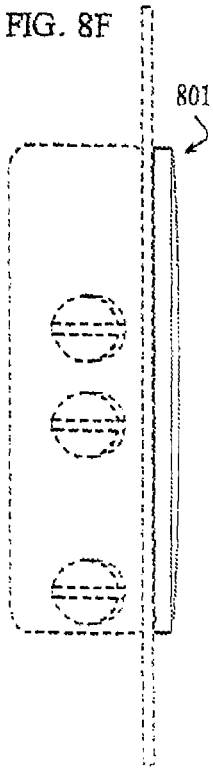
FIG. 8F is a side view of a design of outlet faceplate 801.

FIG. 8F is a side view of a design of outlet faceplate 801.

Figure 8G:
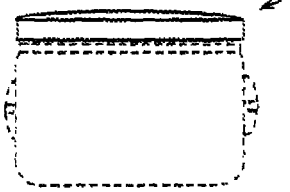
FIG. 8G is a top view of a design of outlet faceplate 801.

FIG. 8G is a top view of a design of outlet faceplate 801.

Figure 9A:
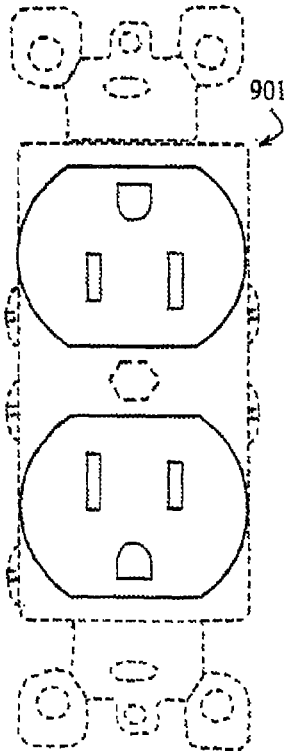
FIG. 9A is a front view of a design of an outlet faceplate 901 of some embodiments of the invention.

FIG. 9A is a front view of a design of an outlet faceplate 901 of some embodiments of the invention, with a grounds-out configuration and having truncated-circle receptacle faces.

Figure 9B:
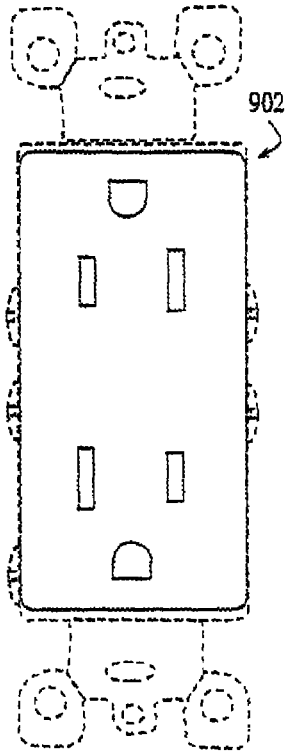
FIG. 9B is a front view of a design of an outlet faceplate 902 of some embodiments of the invention.

FIG. 9B is a front view of a design of an outlet faceplate 902 of some embodiments of the invention, with a grounds-out configuration and having a Decora™-type receptacle face.

Figure 9C:
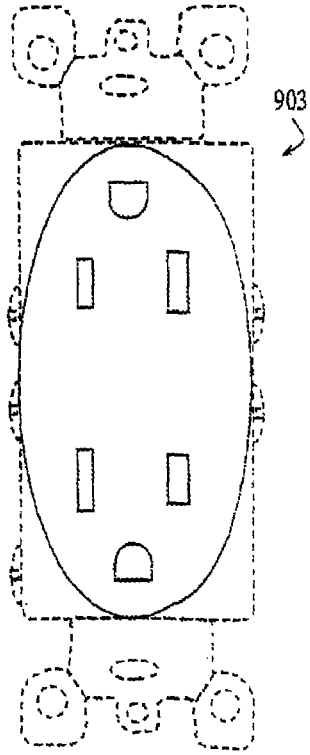
FIG. 9C is a front view of a design of an outlet faceplate 903 of some embodiments of the invention.
Figure 9D:
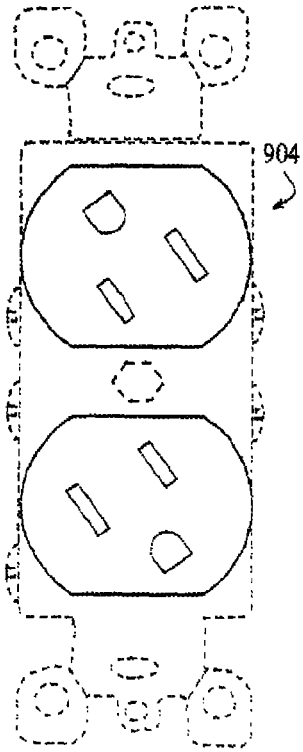
FIG. 9D is a front view of a design of an outlet faceplate 904 of some embodiments of the invention.

FIG. 9C is a front view of a design of an outlet faceplate 903 of some embodiments of the invention, substantially the same as FIG. 7A.

FIG. 9D is a front view of a design of an outlet faceplate 904 of some embodiments of the invention, with a parallel-slanted grounds-out configuration and having truncated-circle receptacle faces.

Figure 9E:
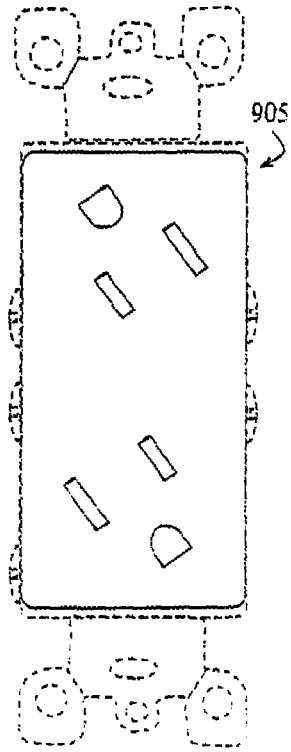
FIG. 9E is a front view of a design of an outlet faceplate 905 of some embodiments of the invention.

FIG. 9E is a front view of a design of an outlet faceplate 905 of some embodiments of the invention, with a parallel-slanted grounds-out configuration and having a Decora™-type receptacle face.

Figure 9F:
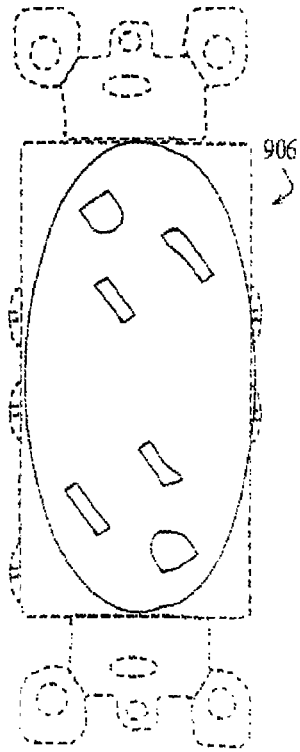
FIG. 9F is a front view of a design of an outlet faceplate 906 of some embodiments of the invention.
Figure 9G:
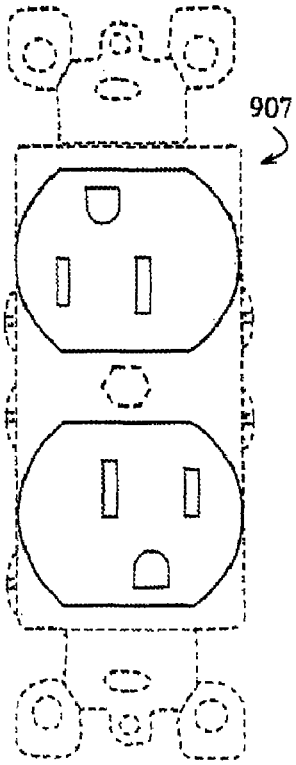
FIG. 9G is a front view of a design of an outlet faceplate 907 of some embodiments of the invention.

FIG. 9F is a front view of a design of an outlet faceplate 906 of some embodiments of the invention, with a parallel-slanted grounds-out configuration and having an oval-type receptacle face as in FIG. 7A.

FIG. 9G is a front view of a design of an outlet faceplate 907 of some embodiments of the invention, with a laterally offset grounds-out configuration and having truncated-circle receptacle faces.

Figure 9H:
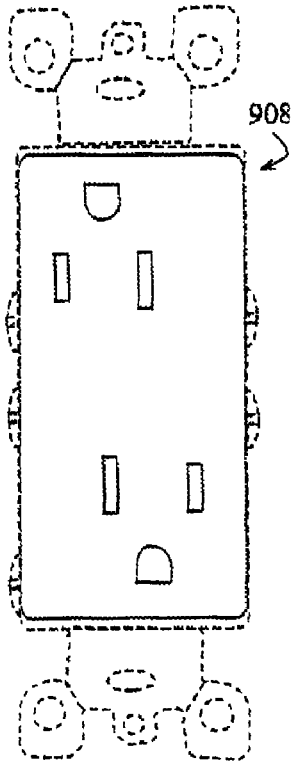
FIG. 9H is a front view of a design of an outlet faceplate 908 of some embodiments of the invention.

FIG. 9H is a front view of a design of an outlet faceplate 908 of some embodiments of the invention, with a laterally offset grounds-out configuration and having a Decora™-type receptacle face.

Figure 9I:
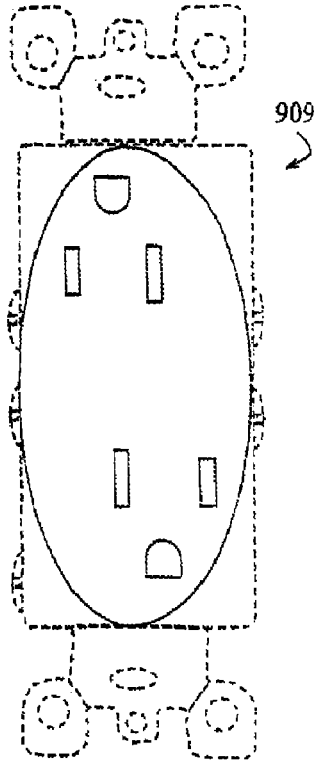
FIG. 9I is a front view of a design of an outlet faceplate 909 of some embodiments of the invention.
Figure 9J:
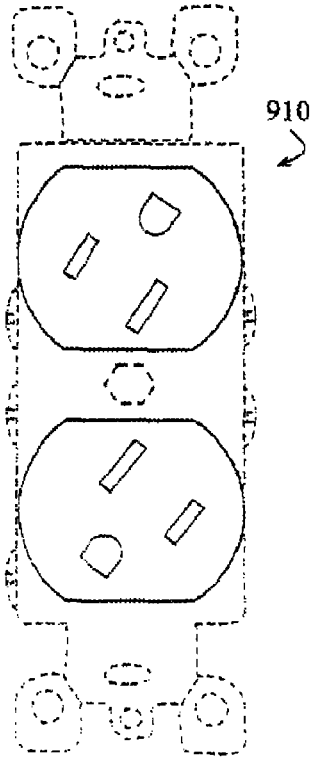
FIG. 9J is a front view of a design of an outlet faceplate 910 of some embodiments of the invention.

FIG. 9I is a front view of a design of an outlet faceplate 909 of some embodiments of the invention, with a laterally offset grounds-out configuration and having an oval-type receptacle face as in FIG. 7A.

FIG. 9J is a front view of a design of an outlet faceplate 910 of some embodiments of the invention, with a different parallel-slanted grounds-out configuration and having truncated-circle receptacle faces.

Figure 9K:
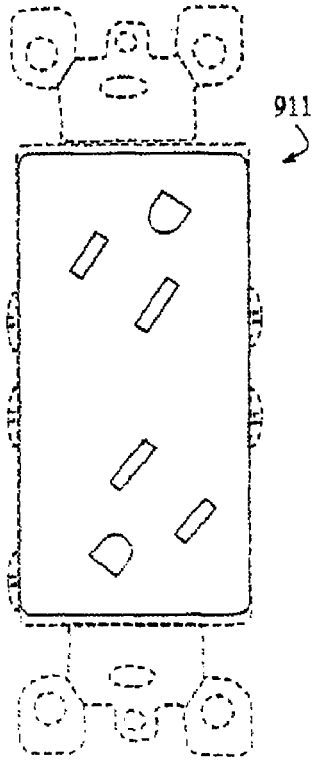
FIG. 9K is a front view of a design of an outlet faceplate 911 of some embodiments of the invention.

FIG. 9K is a front view of a design of an outlet faceplate 911 of some embodiments of the invention, with a different parallel-slanted grounds-out configuration and having a Decora™-type receptacle face.

Figure 9L:
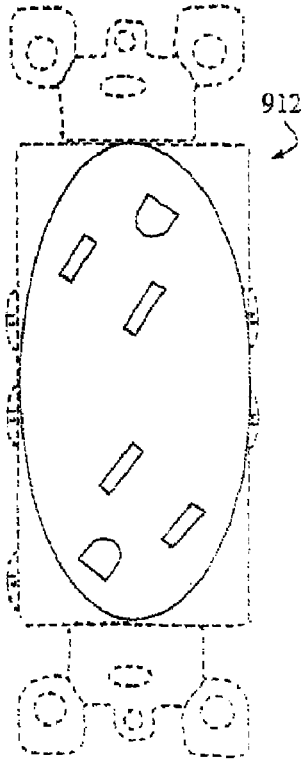
FIG. 9L is a front view of a design of an outlet faceplate 912 of some embodiments of the invention.

FIG. 9L is a front view of a design of an outlet faceplate 912 of some embodiments of the invention, with a different parallel-slanted grounds-out configuration and having an oval-type receptacle face as in FIG. 7A.

Figure 9M:
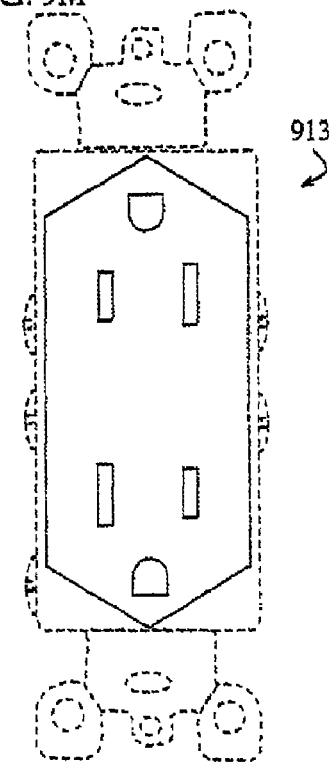
FIG. 9M is a front view of a design of an outlet faceplate 913 of some embodiments of the invention.

FIG. 9M is a front view of a design of an outlet faceplate 913 of some embodiments of the invention, with a grounds-out configuration and having a six-sided receptacle face.

FIG. 9M is a front view of a design of an outlet faceplate 913 of some embodiments of the invention, with a grounds-out configuration and having truncated-circle receptacle faces.

Figure 9N:
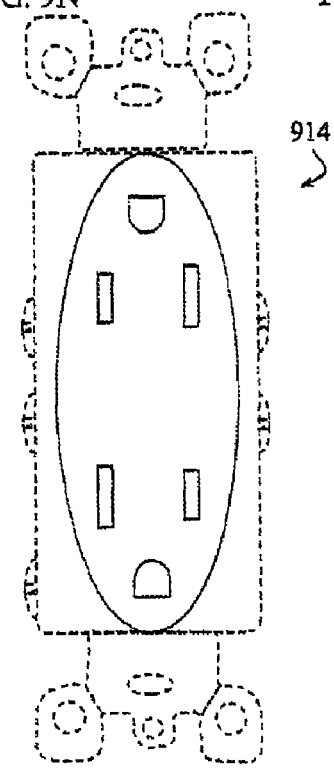
FIG. 9N is a front view of a design of an outlet faceplate 914 of some embodiments of the invention.

FIG. 9N is a front view of a design of an outlet faceplate 914 of some embodiments of the invention, with a grounds-out configuration and having a single narrow oval-type receptacle face.

Figure 9O:
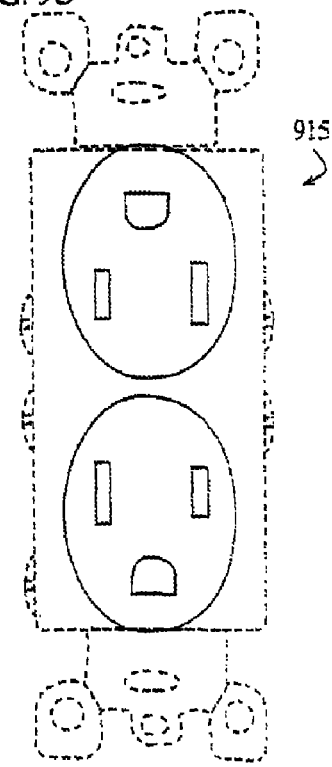
FIG. 9O is a front view of a design of an outlet faceplate 915 of some embodiments of the invention.

FIG. 9O is a front view of a design of an outlet faceplate 915 of some embodiments of the invention, with a grounds-out configuration and having dual (two separated) narrow oval-type receptacle faces.

Figure 9P:
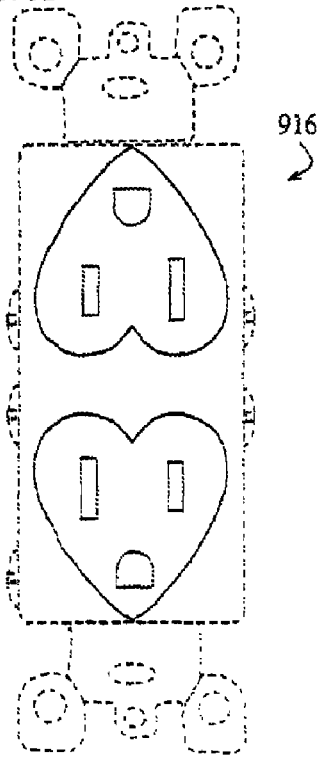
FIG. 9P is a front view of a design of an outlet faceplate 916 of some embodiments of the invention.

FIG. 9P is a front view of a design of an outlet faceplate 916 of some embodiments of the invention, with a grounds-out configuration and having dual (two separated) narrow heart-shaped receptacle faces.

Figure 9Q:
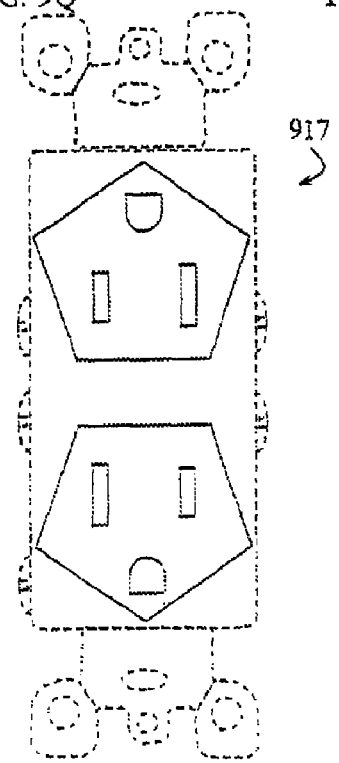
FIG. 9Q is a front view of a design of an outlet faceplate 917 of some embodiments of the invention.

FIG. 9Q is a front view of a design of an outlet faceplate 917 of some embodiments of the invention, with a grounds-out configuration and having dual (two separated) pentagon-shaped receptacle faces.

Figure 9R:
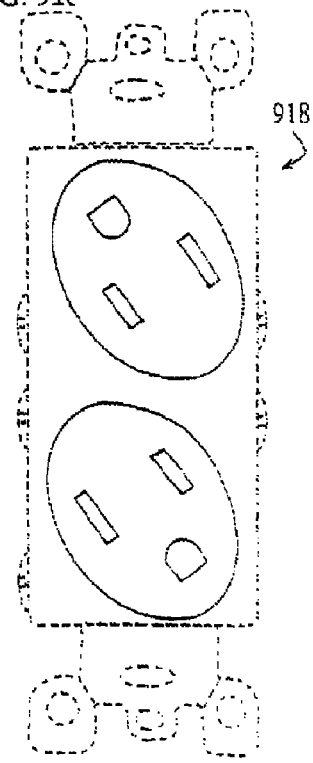
FIG. 9R is a front view of a design of an outlet faceplate 918 of some embodiments of the invention.

FIG. 9R is a front view of a design of an outlet faceplate 918 of some embodiments of the invention, with a parallel-slanted grounds-out configuration and having dual (two separated) narrow oval-type receptacle faces.

Figure 10C:
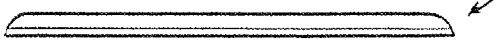
FIG. 10C is a top view of a design of outlet faceplate cover 1000.
Figure 10B:
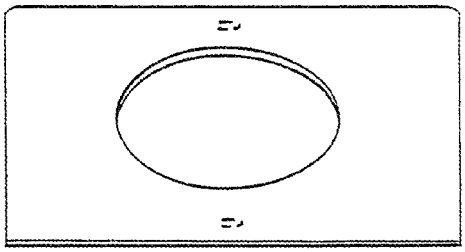
FIG. 10B is a top-front diagonal view of a design of outlet faceplate cover 1000.
Figure 10A:
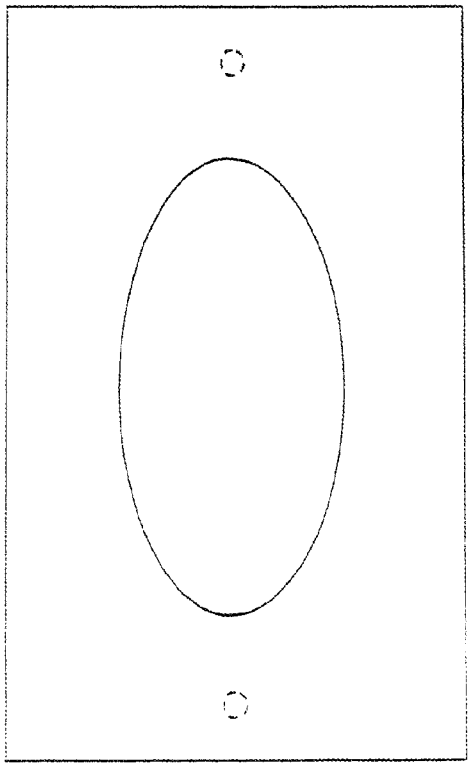
FIG. 10A is a front view of a design of an outlet faceplate cover 1000 of some embodiments of the invention.

FIG. 10A is a front view of a design of an outlet faceplate cover 1000 of some embodiments of the invention. In some embodiments, the oval hole closely matches the shape of oval faceplate 700 of FIG. 7A or 8A, and is sized to easily and snugly fit over such an outlet face.

FIG. 10B is a top-front diagonal view of a design of outlet faceplate cover 1000.

FIG. 10C is a top view of a design of outlet faceplate cover 1000.

Figure 10F:
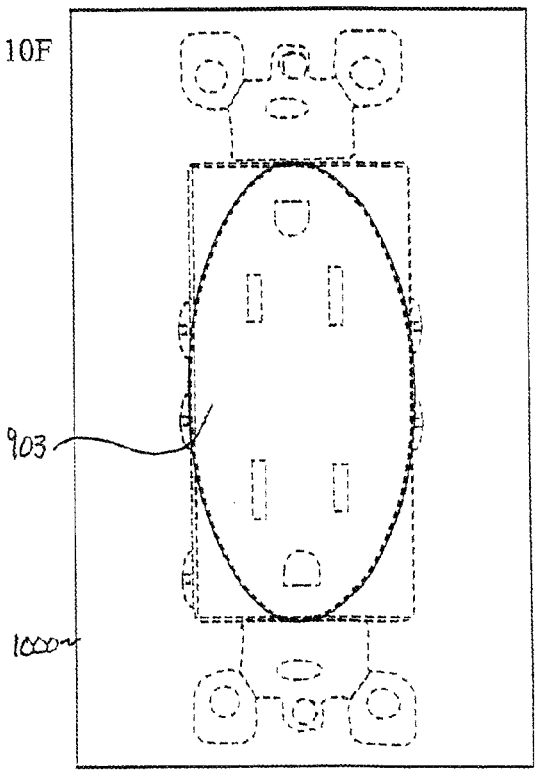
FIG. 10F is a front view of a design of outlet faceplate cover 1000 showing its relationship to design 903 of FIG. 9C.
Figure 10D:
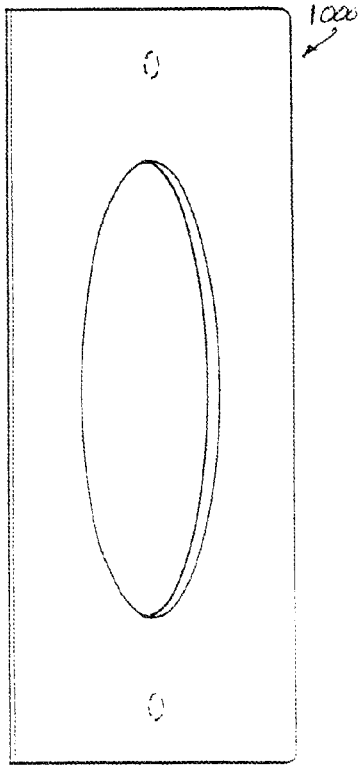
FIG. 10D is a front-side diagonal view of a design of outlet faceplate cover 1000.

FIG. 10D is a front-side diagonal view of a design of outlet faceplate cover 1000.

Figure 10E:
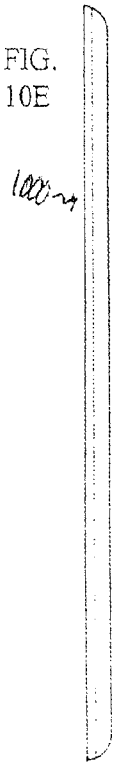
FIG. 10E is a side view of a design of an outlet faceplate cover 1000.

FIG. 10E is a side view of a design of an outlet faceplate cover 1000.

FIG. 10F is a front view of a design of outlet faceplate cover 1000 showing its relationship to, for example and in some embodiments, design 903 of FIG. 9C.

Figure 11B:
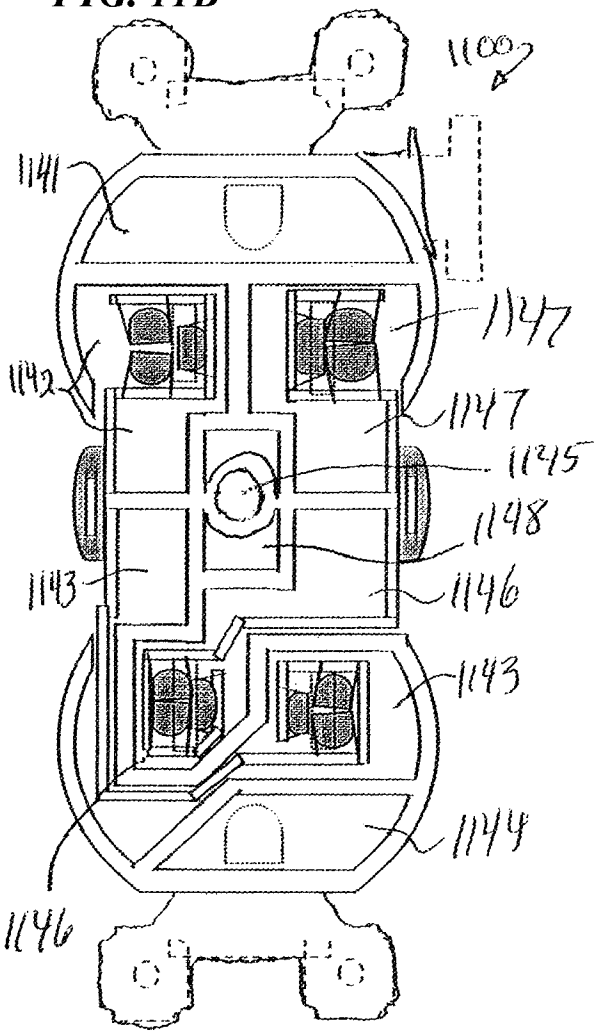
FIG. 11B is a front assembled diagram of an outlet 1100 of some embodiments of the invention.
Figure 11A:
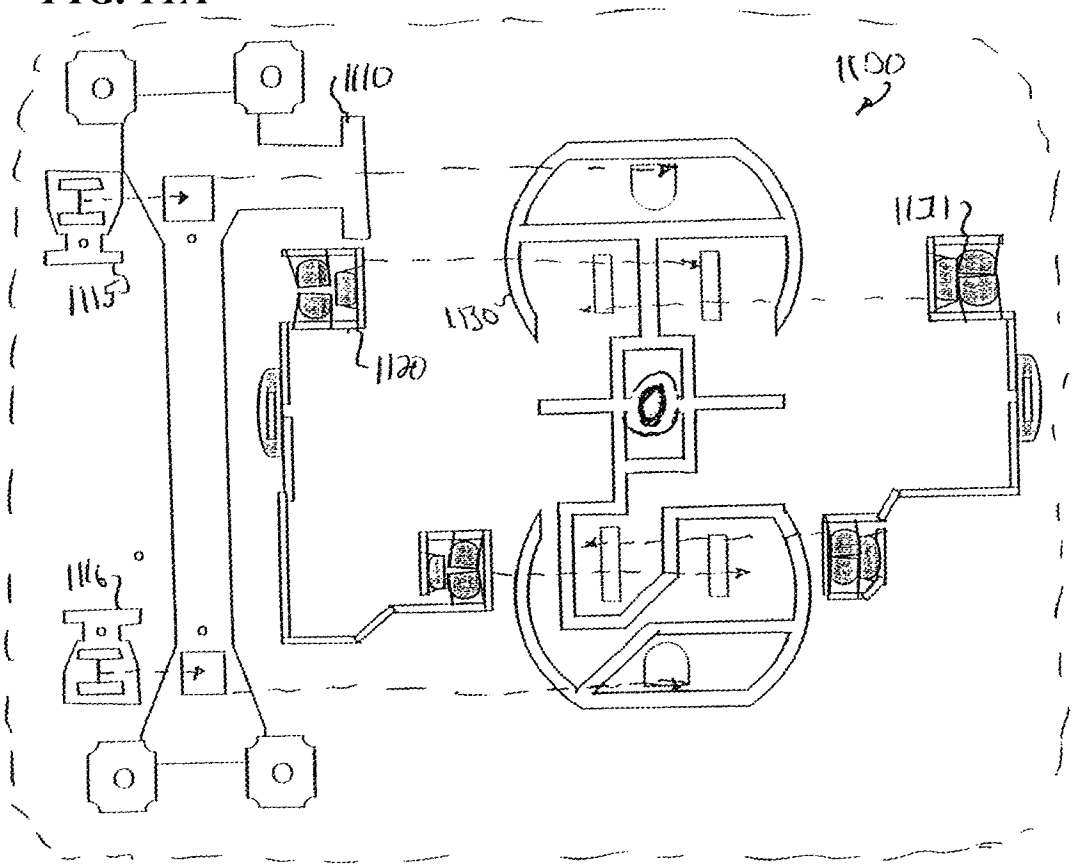
FIG. 11A is a front exploded diagram of an outlet back portion 1100 of some embodiments of the invention.

FIG. 11A is a front exploded diagram an outlet back portion 1100 of some embodiments of the invention. In some embodiments, outlet back portion 1100 includes a ground plate 1110 having two ground-prong receiving units 1115 and 1116 spot-welded, riveted, or otherwise connected to it, hot conductive buss 1120, neutral conductive buss 1121, and pocketed insulator back housing 1130.

FIG. 11B is a front assembled diagram an outlet back portion 1100 of some embodiments of the invention. As assembled, back portion 1100 includes separate insulated pockets for each separate or separable portion of the conductive circuits. That is, pocket 1141 for the upper ground socket, pocket 1142 for the upper hot socket and for the upper left hot screw connection, pocket 1143 for the lower hot socket and for the lower-left hot screw connection, pocket 1144 for the lower ground socket, pocket 1145 for the central grounding screw, pocket 1146 for the lower neutral socket and for the lower-right neutral screw connection, and pocket 1147 for the upper neutral socket and for the upper-left neutral screw connection.

Figures 12A, 12B, 12C, 12D, 12E:
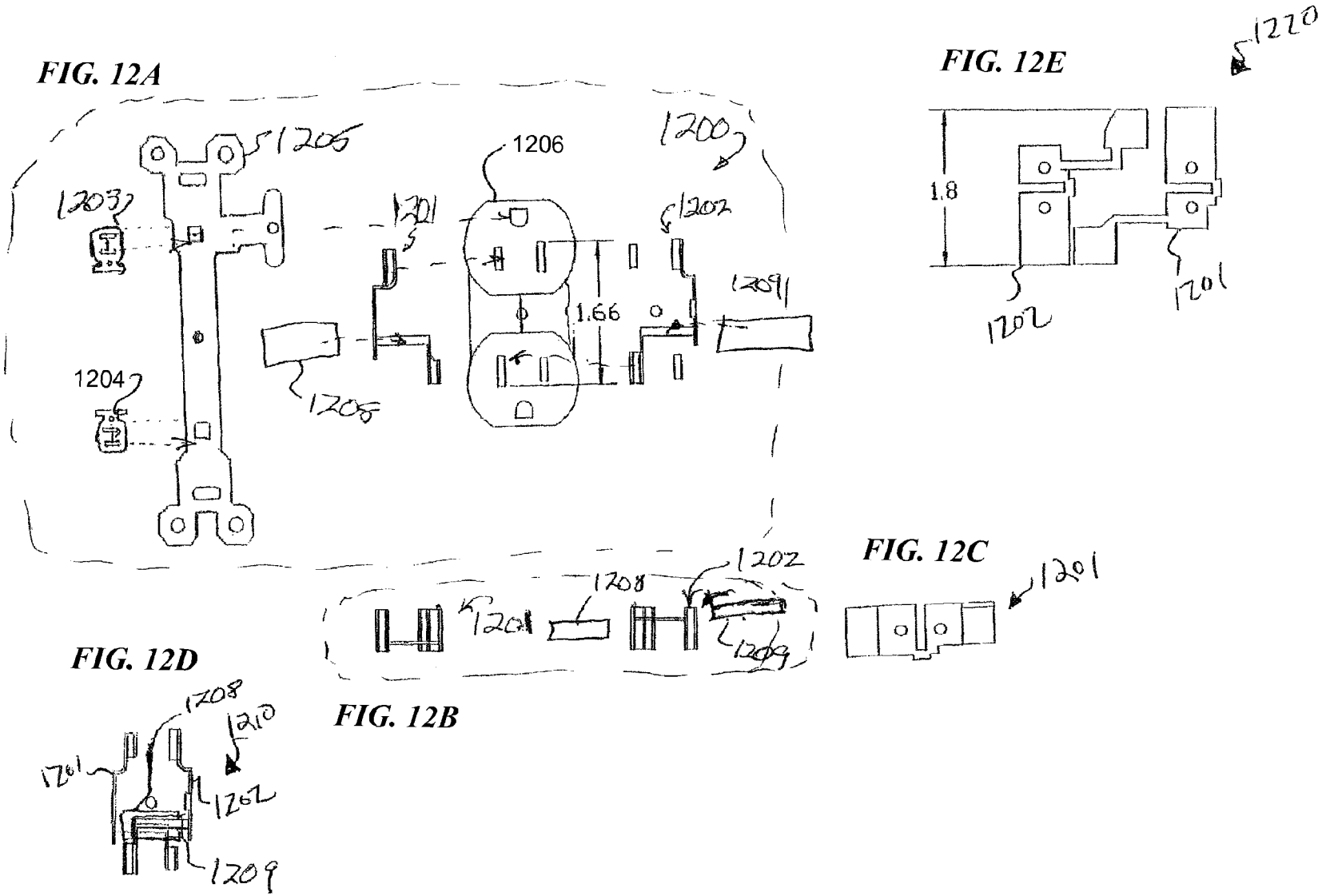
FIG. 12A is a front exploded diagram of an outlet back portion 1200 of some embodiments of the invention.
FIG. 12B is a top exploded diagram of conductive busses 1201 and 1202.
FIG. 12C is a side-view diagram of conductive buss 1201.
FIG. 12D is a top-view diagram of conductor structure 1210 including conductive busses 1201 and 1202, showing the over-under cross-over configuration of the hot and neutral busses, and insulators 1208 and 1209 that separate these from one another and from the ground plate 1205, respectively.
FIG. 12E is the cut-out template for punching out metal pieces for folding and forming conductive busses 1201 and 1202.

FIG. 12A is a front exploded diagram of an outlet 1200 of some embodiments of the invention. In some embodiments, outlet 1200 includes grounding plate 1205, ground-pin connectors 1203 and 1204, hot conductive buss 1201, neutral conductive buss 1202, and faceplate/housing 1206. Buss insulators 1208 and 1209 (typically made of plastic) are placed between each pair of conductors (1201-1202 and 1202-1205) to form separators that prevent shorting of the conductors.

FIG. 12B is a top exploded diagram of conductive busses 1201 and 1202 (this is the top exploded view of the hot and neutral busses of FIG. 12A) and insulators 1208 and 1209.

FIG. 12C is a side-view diagram of conductive buss 1201.

FIG. 12D is a top-view diagram of assembled conductor structure 1210 including conductive busses 1201 and 1202. Structure 1210 includes conductive busses 1201 and 1202 (this is the front assembled view of the hot and neutral busses of FIG. 12A) and insulators 1208 and 1209.

FIG. 12E is the cut-out template or pattern for punching out metal pieces for folding and forming conductive busses 1201 and 1202, in some embodiments.

Figure 13A:
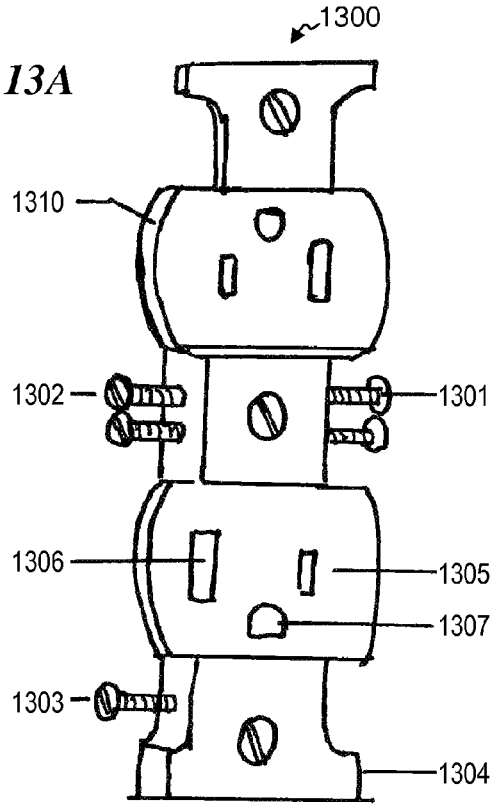

FIG. 13A illustrates an exemplary assembly 1300 which provides a duplex receptacle outlet that makes specific improvements to receptacle design in comparison to historically problematic areas. The assembly 1300 provides a front view of a duplex three prong A.C. receptacle which is uniquely designed to allow two larger than standard plugs or plugs with their electrical cords arranged at 90 degrees to the plug, to be plugged in at the same time. This application is not possible with a conventional receptacle. In the duplex arrangement described by assembly 1300 the outlets 1310 are arranged in a reverse orientation, one to the other, as opposed to the same orientation as with a conventional receptacle. Each outlet contains a hot contact 1305, a hot wire reception screw 1301, a neutral contact 1306, a neutral wire reception screw 1302, a ground contact 1307, a ground wire reception screw 1303 and a grounded mounting plate 1304. Although the hot contacts 1305 and the neutral contacts 1306 are arranged in reverse directions from the upper to the lower outlet 1310 and the ground contacts 1307 are in opposite orientation, this orientation of wire reception screws 1301, 1302 and 1303 are maintained by convention and for safety reasons, as they are on a conventional receptacle. The hot wire reception screws 1301 are arranged on the same side of the receptacle in near proximity to the outlets they service. Likewise, the neutral wire reception screws 1302 are arranged on the same side of the receptacle, opposite that of the hot wire reception screws 1301. The electrical polarities are kept apart to avoid short circuit of hot to neutral. To reverse the contact orientation of the outlets 1310, the internal routing of the electrical busses provide connection across the receptacle for the upper outlet 1310 as shown in FIG. 13A.

Figure 13B:
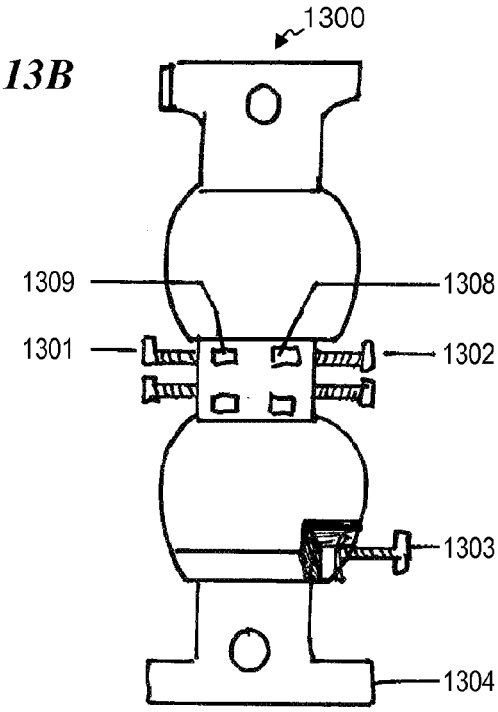

FIG. 13B illustrates the back side of the duplex receptacle, assembly 1310. The notable additions in this figure over FIG. 13A are the presence of hot reception sites 1309 and neutral reception sites 1308. These are also arranged by convention on the correct polarity sides. The hot wire reception site is near and connected in common with the hot wire reception screw. The neutral wire reception site is near and connected in common with the neutral wire reception screw. This view of assembly 1310 also shows the ground wire connection screw in common connection with the mounting plate 1304. This connection is made to carry out the ground path to the electrical box which should be short circuit protected.

In some embodiments, the present invention includes a method for making a duplex electrical outlet, including configuring the outlet to have a first power receptacle and a second power receptacle both having a receptacle face oriented to the front of the outlet, each power receptacle having a hot socket, a neutral socket, and a ground socket configured to receive a three-pronged plug having a hot prong, a neutral prong, and a ground prong, respectively. Additionally, this method includes orienting the first power receptacle such that its ground socket is further from the second power receptacle than its hot socket and neutral socket, orienting the second power receptacle such that its ground socket is further from the first power receptacle than its hot socket and neutral socket, electrically connecting the socket of the first power receptacle to the hot socket of the second power receptacle with a first metal buss configured to connect to external wiring only along a first side of the outlet, electrically connecting the neutral socket of the first power receptacle to the neutral socket of the second power receptacle with a second metal buss or conducting buss configured to connect to external wiring only along a second side of the outlet opposite to the first side of the outlet, and electrically connecting the ground socket of the first power receptacle to the ground socket of the second power receptacle with a third metal buss or ground buss configured to connect to external wiring along the second side of the outlet.

In some embodiments, this method further includes providing a threaded screw receiver substantially centered on a recessed surface between first power receptacle and the second power receptacle, and spacing the first power receptacle from the second power receptacle such that they accommodate a standard cover plate having two power receptacle openings and one screw opening.

In some embodiments, this method additionally includes providing substantially identical back portions and conductor configurations for each of at least two different front receptacle face configurations, the two different front receptacle face configurations including a first front-receptacle face configuration having a substantially planar rectangular raised front receptacle face having both power receptacles therein, and a second front-receptacle face configuration having two separated raised front-receptacle face portions each shaped as a truncated circle. In still further embodiments, this method further includes connecting a hot conductive buss to at least a first and a second hot screw each providing a clamp mechanism that clamps electrical wiring to the hot conductive buss that connects the first line screw to the hot socket of the first power receptacle and connects the second line screw to the hot socket of the second power receptacle.

In some embodiments, a duplex power receptacle is configured to mount in a standard wall outlet box, and to be wired to conventional in-wall wiring, where each of two power receptacles have a hot socket, a neutral socket and a ground socket where in at least one of the ground sockets is in a ground-up position relative to the ground socket of a second power receptacle which is in a ground-down position.

In some embodiments, a duplex power receptacle is provided, wherein the two power receptacles are configured such that there is an upper and lower power receptacle each having a receptacle face oriented to the front of the outlet, each power receptacle having a hot socket, a neutral socket, and a ground socket configured to receive a three-prong power plug having a hot prong, a neutral prong, and a ground prong. In still other embodiments, the dual power receptacle is disclosed wherein the upper power receptacle is configured such that ground socket is further from the lower power receptacle than its hot socket and neutral sockets, the lower power receptacle is oriented such that its ground socket is further from the upper power receptacle than its hot socket and neutral sockets, the hot socket of the upper power receptacle and the hot socket of the lower power receptacle are connected via a first conductive buss to a circuit, the neutral socket of the upper power receptacle and neutral socket of the lower power receptacle are connected via a second conductive buss to a circuit referencing FIG. 1A, and the ground socket of the upper and lower power receptacles are connected to a ground circuit. The circuit attached to the conductive buss of the hot socket wherein the circuit is attached via one or more threaded terminal screws.

In some embodiments, a circuit is attached to the conductive buss of the neutral socket wherein the circuit is attached via one or more threaded terminal screws.

In some embodiments, the ground sockets of the upper and lower power receptacles are each connected to a ground circuit via a threaded grounding screw.

In some embodiments, the apparatus further includes a threaded screw receiver substantially centered on a recessed surface plate between first power receptacle and the second power receptacle, and a standard duplex power receptacle face. In still other embodiments, the standard duplex power receptacle face is disclosed, wherein the receptacle face has a planar rectangular raised front receptacle face, and a second receptacle face configuration is disclosed having two separated raised front-receptacle face portions each shaped as a truncated circle. In some embodiments, the standard duplex power receptacle face is disclosed, wherein the first power receptacle is an upper power receptacle, and the second power receptacle is a lower power receptacle. In some embodiments, the upper power receptacle may be configured at an angle relative to the lower power receptacle or the upper at an angle relative to the lower.

In some embodiments, the apparatus includes a first hot conductive buss, and a second neutral conductive buss, with the first hot conductive buss oriented above the second neutral conductive buss.

In some embodiments, the first hot conductive buss includes two sets of three gripping prongs. Moreover, in some embodiments, the second neutral conductive buss includes two sets of three gripping prongs. In still other embodiments, the apparatus further includes the second neutral conductive buss oriented above the first hot conductive buss.

The apparatus, in some embodiments, has a first hot conductive buss and the second neutral conductive buss both having an upper and lower portion. The upper and lower portions can be configured such that these upper portions are at an angle.

In some embodiments, the apparatus further includes a body with isolating compartments into which are placed the hot and neutral conducting busses and associated gripping prongs. The apparatus additionally includes a ground buss and attached to the ground buss is a grounding screw, ground tab, a yoke, and clamp nut.

In some embodiments, a structure is envisioned containing a means for simultaneously utilizing a first power plug in a ground-up configuration and a second power plug in a ground-down configuration, a means for receiving the first and second power plugs, a means for attaching one or more circuits to the apparatus, a means for receiving electrical power through the circuits, a means for supplying this electrical power to the first and second power plugs, a means for attaching a ground to the apparatus, and a means for attaching the apparatus to a standard wall outlet box is disclosed.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A method comprising:

configuring a power outlet to have a first power receptacle and a second power receptacle both having a receptacle face oriented to a front of the outlet, each power receptacle having a hot socket, a neutral socket, and a ground socket configured to receive a three-pronged plug having a hot conductive buss prong, a neutral prong, and a ground prong, respectively;

fixedly orienting the first power receptacle such that the first power receptacle's ground socket is further from the second power receptacle than are the first power receptacle's hot socket and neutral socket;

fixedly orienting the second power receptacle such that the second power receptacle's ground socket is further from the first power receptacle than are the second power receptacle's hot socket and neutral socket;

electrically connecting a first hot-wire reception site to the first power receptacle's hot socket and electrically connecting a second hot-wire reception site to the second power receptacle's hot socket, and internally routing a first metal buss from the first hot-wire reception site across the first power receptacle to the first power receptacle's hot socket, wherein the first hot-wire reception site and the second hot-wire reception site are on a first side of the power outlet;

electrically connecting a first neutral-wire reception site to the first power receptacle's neutral socket and electrically connecting a second neutral-wire reception site to the second power receptacle's neutral socket, and internally routing a second metal buss from the first neutral-wire reception site across the first power receptacle to the first power receptacle's neutral socket, wherein the first neutral-wire reception site and the second neutral-wire reception site are on a second side of the power outlet that is opposite the first side of the power outlet;

electrically connecting the ground socket of the first power receptacle to the ground socket of the second power receptacle with a third metal buss configured to connect to external wiring along the second side of the outlet;

pocketing the first metal buss in a first buss-insulator pocket that has an electrically insulating wall separating the first metal buss from the neutral socket of the first power receptacle as the first metal buss extends across the first power receptacle from the first hot-wire reception site to the first power receptacle's hot socket; and pocketing the second metal buss in a second buss-insulator pocket having an electrically insulating wall separating the second metal buss from the hot socket of the first power receptacle as the second metal buss extends across the first power receptacle from the first neutral-wire reception site to the first power receptacle's neutral socket.

2. The method of claim 1, further comprising:

forming a threaded screw receiver substantially centered on a recessed surface plate between the first power receptacle and the second power receptacle; and spacing the first power receptacle from the second power receptacle such that they accommodate a standard outlet face plate having two power receptacle openings and one screw opening.

3. The method of claim 1, further comprising:

electrically connecting a first hot screw to the first hot-wire reception site, wherein the first hot screw is configured to clamp a hot wire to the outlet;

electrically connecting a second hot screw to the second hot-wire reception site, wherein the second hot screw is configured to clamp a hot wire to the outlet;

electrically connecting a first neutral screw to the first neutral-wire reception site, wherein the first neutral screw is configured to clamp a neutral wire to the outlet;

electrically connecting a second neutral screw to the second neutral-wire reception site, wherein the second neutral screw is configured to clamp a neutral wire to the outlet;

pocketing a threaded end of the first hot screw in a first screw-insulator pocket, and passing the first metal buss through an opening between the first screw-insulator pocket and the first buss-insulator pocket;

pocketing a threaded end of the second hot screw in a second screw-insulator pocket and insulating the second screw-insulator pocket from the first screw-insulator pocket;

pocketing a threaded end of the first neutral screw in a third screw-insulator pocket and insulating the third screw-insulator pocket from the first screw-insulator pocket, and passing the second metal buss through an opening between the third screw-insulator pocket and the second buss-insulator pocket; and pocketing a threaded end of the second neutral screw in a fourth screw-insulator pocket and insulating the fourth screw-insulator pocket from the third screw-insulator pocket and insulating the fourth screw-insulator pocket from the second screw-insulator pocket.

4. The method of claim 1, further comprising:

configuring the first metal buss to be readily separable into a first portion and a second portion that are electrically disconnected from one another, such that when its first portion and its second portion are electrically disconnected the first hot-wire reception site is electrically connected to the first hot socket and the second hot-wire reception site is electrically connected to the second hot socket, but the first hot socket is electrically isolated from the second hot socket.

5. The method of claim 1, further comprising:

configuring the second metal buss to be readily separable into a first portion and a second portion that are electrically disconnected from one another, such that when its first portion and its second portion are electrically disconnected the first neutral-wire reception site is electrically connected to the first neutral socket and the second neutral-wire reception site is electrically connected to the second neutral socket, but the first neutral socket is electrically isolated from the second neutral socket.

6. The method of claim 1, further comprising:

configuring the first metal buss to be readily separable into a first portion and a second portion that are electrically disconnected from one another, such that when its first portion and its second portion are electrically disconnected the first hot-wire reception site is electrically connected to the first hot socket and the second hot-wire reception site is electrically connected to the second hot socket, but the first hot socket is electrically isolated from the second hot socket; and configuring the second metal buss to be readily separable into a first portion and a second portion that are electrically disconnected from one another, such that when its first portion and its second portion are electrically disconnected the first neutral-wire reception site is electrically connected to the first neutral socket and the second neutral-wire reception site is electrically connected to the second neutral socket, but the first neutral socket is electrically isolated from the second neutral socket.

7. The method of claim 1, further comprising:

electrically connecting a first hot screw to the first hot-wire reception site, wherein the first hot screw is configured to clamp a hot wire to the outlet;

electrically connecting a second hot screw to the second hot-wire reception site, wherein the second hot screw is configured to clamp a hot wire to the outlet;

electrically connecting a first neutral screw to the first neutral-wire reception site, wherein the first neutral screw is configured to clamp a neutral wire to the outlet; and electrically connecting a second neutral screw to the second neutral-wire reception site, wherein the second neutral screw is configured to clamp a neutral wire to the outlet, wherein both hot-wire reception sites are located on a first side of the power outlet, and wherein both neutral-wire reception sites are located on the second side of the power outlet.

8. The method of claim 1, wherein the internally routing of the first metal buss includes routing the first metal buss to follow a path from the first hot-wire reception site to the first power receptacle's hot socket that passes the first power receptacle's neutral socket on a side of the first power receptacle's neutral socket that is farthest from the second power receptacle's hot socket, and wherein the internally routing of the second metal buss includes routing the second metal buss to follow a path from the first neutral-wire reception site to the first power receptacle's neutral socket that passes the first power receptacle's hot socket on a side of the first power receptacle's hot socket that is closest to the second power receptacle's neutral socket.

9. The method of claim 1, wherein the internally routing of the first metal buss includes routing the first metal buss to follow a path from the first hot-wire reception site to the first power receptacle's hot socket that passes the first power receptacle's neutral socket on a side of the first power receptacle's neutral socket that is closest to the second power receptacle's hot socket, and wherein the internally routing of the second metal buss includes routing the second metal buss to follow a path from the first neutral-wire reception site to the first power receptacle's neutral socket that passes the first power receptacle's hot socket on a side of the first power receptacle's hot socket that is farthest from the second power receptacle's neutral socket.

10. The method of claim 1, further comprising:

providing at least two different front-receptacle faces including a first front-receptacle face having a single substantially planar rectangular raised face having both power receptacles therein, and a second front-receptacle face having two separated raised face portions each shaped as truncated circles;

configuring conductor portions including the first and second metal busses, and back portions of the outlet such that substantially identical back portions and conductor portions are adopted to be connected to the first front-receptacle face and to the second front-receptacle face;

assembling a first back portion and conductor portion to the first front-receptacle face; and assembling a second back portion and conductor portion, which are substantially identical to the first back portion and conductor portion, to the second front-receptacle face.

11. The method of claim 1, wherein the internally routing of the first metal buss from the first hot-wire reception site across the first power receptacle to the first power receptacle's hot socket includes jointlessly connecting the first hot-wire reception site to the first power receptacle's hot socket with a single piece of metal, and wherein the internally routing of the second metal buss from the first neutral-wire reception site across the first power receptacle to the first power receptacle's neutral socket includes jointlessly connecting the first neutral-wire reception site to the first power receptacle's neutral socket with a single piece of metal.

12. A method comprising:

configuring a power outlet to have a first power receptacle and a second power receptacle both having a receptacle face oriented to a front of the outlet, each power receptacle having a hot socket, a neutral socket, and a ground socket configured to receive a three-pronged plug having a hot conductive buss prong, a neutral prong, and a ground prong, respectively;

fixedly orienting the first power receptacle such that the first power receptacle's ground socket is further from the second power receptacle than are the first power receptacle's hot socket and neutral socket;

fixedly orienting the second power socket receptacle such that the second power receptacle's ground socket is further from the first power receptacle than are the second power receptacle's hot socket and neutral socket;

electrically connecting a first hot-wire reception site to the first power receptacle's hot socket and electrically connecting a second hot-wire reception site to the second power receptacle's hot socket, and internally routing a first metal buss from the first hot-wire reception site across the first power receptacle to the first power receptacle's hot socket;

electrically connecting a first neutral-wire reception site to the first power receptacle's neutral socket and electrically connecting a second neutral-wire reception site to the second power receptacle's neutral socket, and internally routing a second metal buss from the first neutral-wire reception site across the first power receptacle to the first power receptacle's neutral socket; and electrically connecting the ground socket of the first power receptacle to the ground socket of the second power receptacle with a third metal buss configured to connect to external wiring along a second side of the outlet;

electrically connecting a first hot screw to the first hot-wire reception site, wherein the first hot screw is configured to clamp a hot wire to the outlet;

electrically connecting a second hot screw to the second hot-wire reception site, wherein the second hot screw is configured to clamp a hot wire to the outlet;

electrically connecting a first neutral screw to the first neutral-wire reception site, wherein the first neutral screw is configured to clamp a neutral wire to the outlet;

electrically connecting a second neutral screw to the second neutral-wire reception site, wherein the second neutral screw is configured to clamp a neutral wire to the outlet, wherein both hot-wire reception sites are located on a first side of the power outlet, and wherein both neutral-wire reception sites are located on the second side of the power outlet;

pocketing a threaded end of the first hot screw in a first screw-insulator pocket, and passing the first metal buss through an opening between the first screw-insulator pocket and the first buss-insulator pocket;

pocketing a threaded end of the second hot screw in a second screw-insulator pocket and insulating the second screw-insulator pocket from the first screw-insulator pocket;

pocketing a threaded end of the first neutral screw in a third screw-insulator pocket and insulating the third screw-insulator pocket from the first screw-insulator pocket, and passing the second metal buss through an opening between the third screw-insulator pocket and the second buss-insulator pocket;

pocketing a threaded end of the second neutral screw in a fourth screw-insulator pocket and insulating the fourth screw-insulator pocket from the third screw-insulator pocket and insulating the fourth screw-insulator pocket from the second screw-insulator pocket;

configuring the first metal buss to be readily separable into a first portion and a second portion that are electrically disconnected from one another, such that when its first portion and its second portion are electrically disconnected the first hot screw is electrically connected to the first hot socket and the second hot screw is electrically connected to the second hot socket, but the first hot socket is electrically isolated from the second hot socket; and configuring the second metal buss to be readily separable into a first portion and a second portion that are electrically disconnected from one another, such that when its first portion and its second portion are electrically disconnected the first neutral screw is electrically connected to the first neutral socket and the second neutral screw is electrically connected to the second neutral socket, but the first neutral socket is electrically isolated from the second neutral socket.

13. An method comprising:

configuring a duplex in-wall outlet to have a first three-contact power receptacle and a second three-contact power receptacle, wherein the first three-contact power receptacle is arranged above the second three-contact power receptacle, and wherein each three-contact power receptacle includes a hot contact, a neutral contact and a ground contact;

configuring the first three-contact power receptacle in a first orientation and configuring the second three-contact power receptacle in a second orientation, wherein the first orientation is oriented with a 180-degree rotation relative to the second orientation;

electrically connecting the hot contact of the first three-contact power receptacle in common with a first hot-wire reception screw and a first hot-wire reception site, wherein the first hot-wire reception screw and the first hot-wire reception site are both located on a first side of the in-wall outlet, wherein the hot contact of the first three-contact power receptacle is located closer to a second side of the in-wall outlet than to the first side of the in-wall outlet, wherein the second side is opposite the first side, and wherein the electrically connecting of the hot contact of the first three-contact power receptacle includes internally routing a first metal buss from the first side of the in-wall outlet across the first three-contact power receptacle to the hot contact of the first three-contact power receptacle of the in-wall outlet;

electrically connecting the neutral contact of the first three-contact power receptacle in common with a first neutral-wire reception screw and a first neutral-wire reception site, wherein the first neutral-wire reception screw and the first neutral-wire reception site are both located on the second side of the in-wall outlet, wherein the neutral contact of the first three-contact power receptacle is located closer to the first side of the in-wall outlet than to the second side, and wherein the electrically connecting of the neutral contact of the first three-contact power receptacle includes internally routing a second metal buss from the second side of the in-wall outlet across the first three-contact power receptacle to the neutral contact of the first three-contact power receptacle of the in-wall outlet;

electrically connecting the ground contact of the first three-contact power receptacle in common with the ground contact of the second three-contact power receptacle, a ground-wire reception screw, and a grounded mounting plate;

pocketing the first metal buss in a first buss-insulator pocket that has an electrically insulating wall separating the first metal buss from the neutral socket of the first three-contact power receptacle as the first metal buss extends across the first three-contact power receptacle from the first hot-wire reception site to the first power receptacle's hot contact;

pocketing the second metal buss in a second buss-insulator pocket having an electrically insulating wall separating the second metal buss from the hot socket of the first three-contact power receptacle as the second metal buss extends across the first three-contact power receptacle from the first neutral-wire reception site to the first power receptacle's neutral contact;

electrically connecting the hot contact of the second three-contact power receptacle in common with a second hot-wire reception screw and a second hot-wire reception site, wherein the second hot-wire reception screw and the second hot-wire reception site are both located on the first side of the in-wall outlet, and wherein the hot contact of the second three-contact power receptacle is located closer to the first side of the in-wall outlet than to the second side;

electrically connecting the neutral contact of the second three-contact power receptacle in common with a second neutral-wire reception screw and a second neutral-wire reception site, wherein the second neutral-wire reception screw and the second neutral-wire reception site are both located on the second side of the in-wall outlet, and wherein the neutral contact of the second three-contact power receptacle is located closer to the second side of the in-wall outlet than to the first side; and maintaining polarity separation between hot and neutral wires configured to electrically connect to the in-wall outlet, wherein the maintaining of polarity separation includes the locating of the first and second hot-wire reception screws and the first and second hot-wire reception sites on the first side of the in-wall outlet, and the locating of the first and second neutral-wire reception screws and the first and second neutral-wire reception sites on the second side of the in-wall outlet.

14. The method of claim 13, further comprising:

forming a threaded screw receiver substantially centered on a recessed surface plate between the first three-contact power receptacle and the second three-contact power receptacle; and spacing the first three-contact power receptacle from the second three-contact power receptacle such that they accommodate a standard outlet face plate having two three-contact power receptacle openings and one screw opening.

15. The method of claim 13, further comprising:

pocketing a threaded end of the first hot-wire reception screw in a first screw-insulator pocket, and passing the first metal buss through an opening between the first screw-insulator pocket and the first buss-insulator pocket;

pocketing a threaded end of the second hot-wire reception screw in a second screw-insulator pocket and insulating the second screw-insulator pocket from the first screw-insulator pocket;

pocketing a threaded end of the first neutral-wire reception screw in a third screw-insulator pocket and insulating the third screw-insulator pocket from the first screw-insulator pocket, and passing the second metal buss through an opening between the third screw-insulator pocket and the second buss-insulator pocket; and pocketing a threaded end of the second neutral-wire reception screw in a fourth screw-insulator pocket and insulating the fourth screw-insulator pocket from the third screw-insulator pocket and insulating the fourth screw-insulator pocket from the second screw-insulator pocket.

16. The method of claim 13, further comprising:

configuring the first metal buss to be readily separable into a first portion and a second portion that are electrically disconnected from one another, such that when its first portion and its second portion are electrically disconnected the first hot-wire reception screw and the first hot-wire reception site are both electrically connected to the first hot contact and the second hot-wire reception screw and the second hot-wire reception site are both electrically connected to the second hot contact, but the first hot contact is electrically isolated from the second hot contact; and configuring the second metal buss to be readily separable into a first portion and a second portion that are electrically disconnected from one another, such that when its first portion and its second portion are electrically disconnected the first neutral-wire reception screw and the first neutral-wire reception site are both electrically connected to the first neutral contact and the second neutral-wire reception screw and the second neutral-wire reception site are both electrically connected to the second neutral contact, but the first neutral contact is electrically isolated from the second neutral contact.

17. The method of claim 13, wherein the internally routing of the first metal buss includes routing the first metal buss to follow a path from the first hot-wire reception site to the first three-contact power receptacle's hot contact that passes the first three-contact power receptacle's neutral contact on a side of the first three-contact power receptacle's neutral contact that is farthest from the second three-contact power receptacle's hot contact, and wherein the internally routing of the second metal buss includes routing the second metal buss to follow a path from the first neutral-wire reception site to the first three-contact power receptacle's neutral contact that passes the first three-contact power receptacle's hot contact on a side of the first three-contact power receptacle's hot contact that is closest to the second three-contact power receptacle's neutral contact.

18. A method comprising:

configuring a duplex in-wall electrical outlet to have a first three-contact power receptacle and a second three-contact power receptacle, wherein the first three-contact power receptacle is arranged above the second three-contact power receptacle, wherein the first three-contact power receptacle has a first orientation, wherein the second three-contact power receptacle has a second orientation, wherein the second orientation is oriented with a 180-degree rotation relative to the first orientation, and wherein the first three-contact power receptacle includes a first hot contact, a first neutral contact, a first ground contact, a first hot-wire reception screw, a first hot-wire reception site, a first neutral-wire reception screw, and a first neutral-wire reception site, and the second three-contact power receptacle includes a second hot contact, a second neutral contact, a second ground contact, a second hot-wire reception screw, a second hot-wire reception site, a second neutral-wire reception screw, and a second neutral-wire reception site;

spacing the first three-contact power receptacle from the second three-contact power receptacle such that they accommodate a standard outlet face plate having two power receptacle openings;

locating the first and second hot-wire reception screws and the first and second hot-wire reception sites for both the first three-contact power receptacle and the second three-contact power receptacle on a first side of the in-wall outlet;

locating the first and second neutral-wire reception screws and the first and second neutral-wire reception sites for both the first three-contact power receptacle and the second three-contact power receptacle on a second side of the in-wall outlet, wherein the second side is opposite the first side;

electrically connecting the first hot contact of the first three-contact power receptacle with a first buss that extends across the in-wall outlet to the first hot-wire reception site on the first side of the in-wall outlet;

electrically connecting the first neutral contact of the first three-contact power receptacle with a second buss that extends across the in-wall outlet to the first neutral-wire reception site on the second side of the in-wall outlet;

routing a first buss-insulator pocket that has a pair of electrically insulating walls that face one another on opposite sides of the first buss and that extend across the in-wall outlet from the first side of the in-wall outlet to connect to one another and surround the first hot contact of the first three-contact power receptacle;

routing a second buss-insulator pocket that has a pair of electrically insulating walls that face one another on opposite sides of the second buss and that extend across the in-wall outlet from the second side of the in-wall outlet to connect to one another and surround the first neutral contact of the first three-contact power receptacle; and electrically connecting the ground contacts for both the first three-contact power receptacle and the second three-contact power receptacle in common with a mounting plate and a ground screw.

19. The method of claim 18, further comprising:

forming a threaded screw receiver substantially centered on a recessed surface plate between the first three-contact power receptacle and the second three-contact power receptacle; and spacing the first three-contact power receptacle from the second three-contact power receptacle such that they accommodate a standard outlet face plate having two three-contact power receptacle openings and one screw opening.

20. The method of claim 18, further comprising:

pocketing a threaded end of the hot-wire reception screw of the first three-contact power receptacle in a first screw-insulator pocket, and passing the first metal buss through an opening between the first screw-insulator pocket and the first buss-insulator pocket;

pocketing a threaded end of the hot-wire reception screw of the second three-contact power receptacle in a second screw-insulator pocket and insulating the second screw-insulator pocket from the first screw-insulator pocket;

pocketing a threaded end of the neutral-wire reception screw of the first three-contact power receptacle in a third screw-insulator pocket and insulating the third screw-insulator pocket from the first screw-insulator pocket, and passing the second metal buss through an opening between the third screw-insulator pocket and the second buss-insulator pocket; and pocketing a threaded end of the neutral-wire reception screw of the second three-contact power receptacle in a fourth screw-insulator pocket and insulating the fourth screw-insulator pocket from the third screw-insulator pocket and insulating the fourth screw-insulator pocket from the second screw-insulator pocket.

* * * * *